United States Patent [19]

Coles

[11] Patent Number: 4,640,173

[45] Date of Patent: Feb. 3, 1987

[54] ELECTRONIC MUSICAL INSTRUMENT

[76] Inventor: Donald K. Coles, 2505 Capitol Ave., Fort Wayne, Ind. 46806

[21] Appl. No.: 736,701

[22] Filed: May 22, 1985

[51] Int. Cl.[4] ..... G10H 1/00; G10C 3/12

[52] U.S. Cl. ..... 84/1.01; 84/442; 84/448; 84/451; 84/478

[58] Field of Search ..... 84/1.01, 423 R, 442, 84/445, 448, 451, 478, 479 R, 479 A

[56] References Cited

U.S. PATENT DOCUMENTS

| | | | |
|---|---|---|---|
| 2,406,946 | 9/1946 | Firestone | 84/423 |
| 2,484,930 | 10/1949 | Cornelius | 84/1.01 |
| 3,141,371 | 6/1964 | Coles | 84/448 |
| 3,986,422 | 10/1976 | Coles | 84/1.01 |
| 4,009,633 | 3/1977 | Coles | 84/1.01 |
| 4,048,893 | 9/1977 | Coles | 84/1.01 |
| 4,054,079 | 10/1977 | Sohler | 84/423 |
| 4,198,890 | 4/1980 | Massey et al. | 84/1.01 |

*Primary Examiner*—William B. Perkey

[57] ABSTRACT

An electrically-keyed musical instrument has a double-row keyboard in which back digitals alternate with front digitals throughout the keyboard. The keyboard is provided with two sets of landmarks to assist playing from either the traditional notation or a six-tone notation. The musical instrument has an electronic key signature actuator apparatus which may be set to physically actuate any key signature of music written in the traditional notation, so that the diatonic tones in the selected key can be played entirely on the front digitals of the keyboard. The other five tones of the chromatic scale must be played on back digitals of the keyboard. The electronic apparatus also allows the front digitals to play the whole-tone scale or a hexachord scale, and to play the hexachord scale in any selected one of twelve different hexachord keys. A person trained on the instrument in a six-tone notation can, by throwing a switch, easily play music written in the traditional notation. Furthermore, the musical instrument can be used by musicians trained in the traditional system to play music written in the traditional notation, or by throwing a switch, in the six-tone notation.

9 Claims, 40 Drawing Figures

FIG. 1
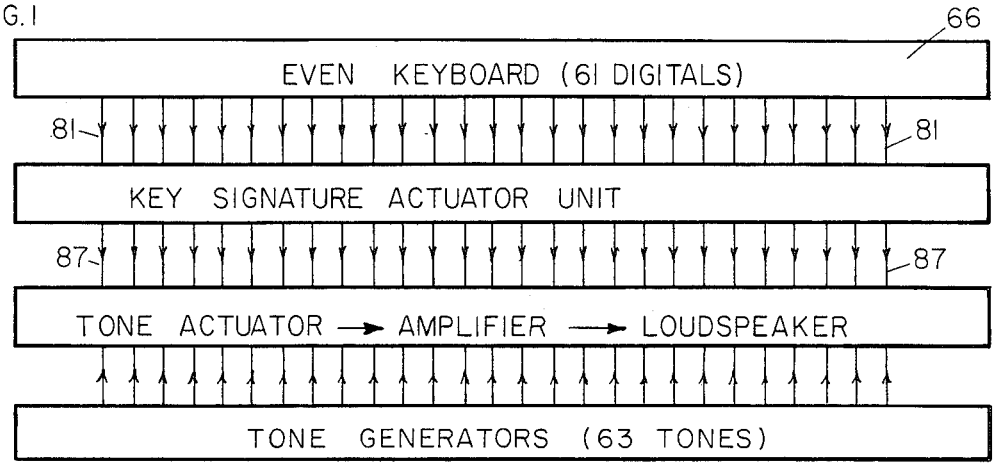
FIG. 2
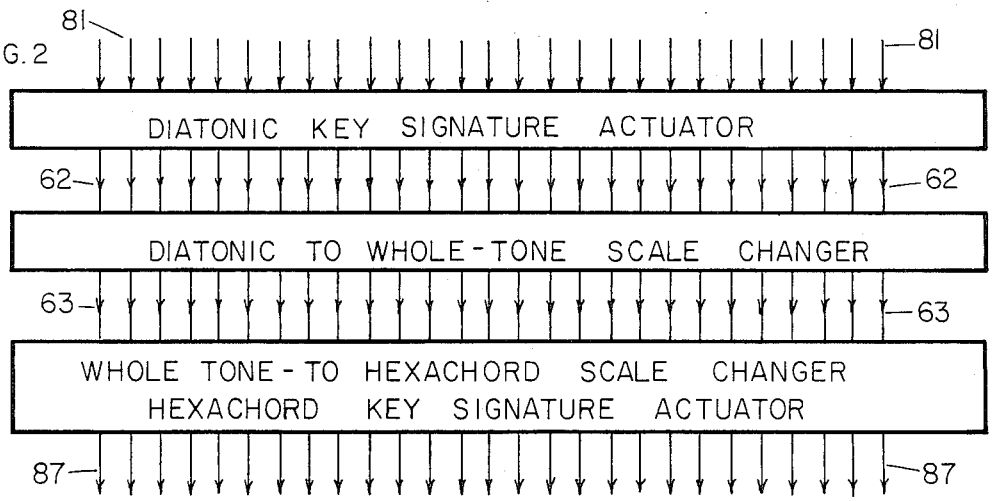
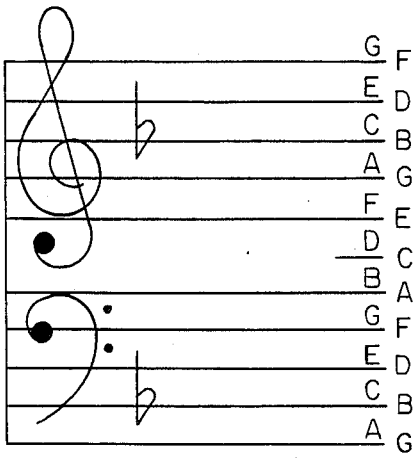
FIG. 3
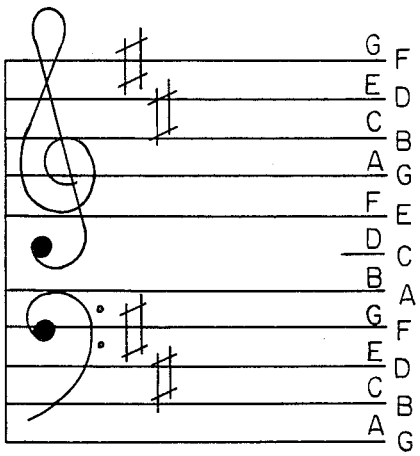
FIG. 4

| 74 | 75 | N′ |
|---|---|---|
| 0 | 0 | N |
| 1 | 0 | N-1 |
| 0 | 1 | N+1 |

| KEY NOTE | NO. OF CHANGES | KEY SIGNATURE SUBSTITUTIONS C | D | E | F | G | A | B |
|---|---|---|---|---|---|---|---|---|
| C♯ | 7♯ | C♯ | D♯ | F | F♯ | G♯ | A♯ | C |
| F♯ | 6♯ | C♯ | D♯ | F | F♯ | G♯ | A♯ | |
| B | 5♯ | C♯ | D♯ | | F♯ | G♯ | A♯ | |
| E | 4♯ | C♯ | D♯ | | F♯ | G♯ | | |
| A | 3♯ | C♯ | | | F♯ | G♯ | | |
| D | 2♯ | C♯ | | | F♯ | | | |
| G | 1♯ | | | | F♯ | | | |
| C | 0 | | | | | | | |
| F | 1♭ | | | | | | | B♭ |
| B♭ | 2♭ | | | E♭ | | | | B♭ |
| E♭ | 3♭ | | | E♭ | | | A♭ | B♭ |
| A♭ | 4♭ | | D♭ | E♭ | | | A♭ | B♭ |
| D♭ | 5♭ | | D♭ | E♭ | | G♭ | A♭ | B♭ |
| G♭ | 6♭ | B | D♭ | E♭ | | G♭ | A♭ | B♭ |
| C♭ | 7♭ | B | D♭ | E♭ | E | G♭ | A♭ | B♭ |

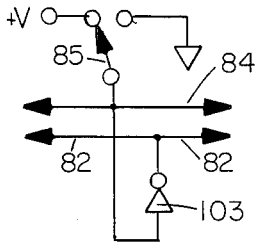
FIG. 15
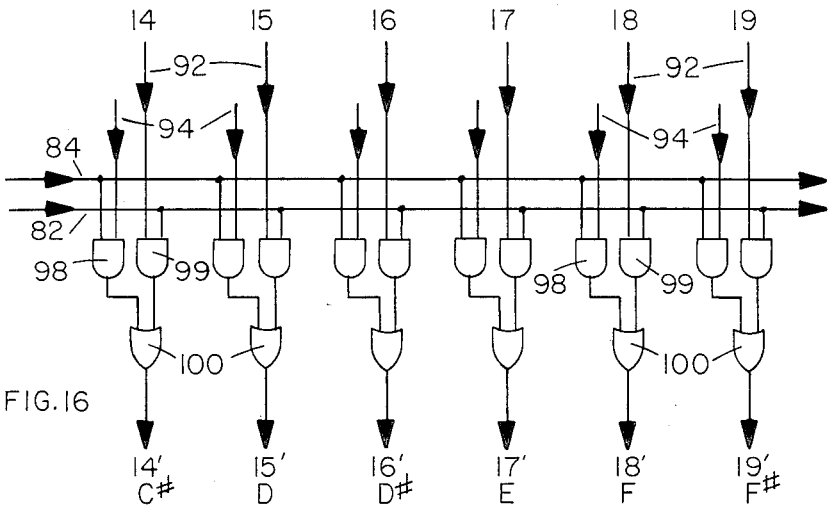
FIG. 16
FIG. 17
| KEY NOTE | NO. OF CHANGES | KEY SIGNATURE SUBSTITUTIONS c | d | e | f | g | a |
|---|---|---|---|---|---|---|---|
| a# | 3# | c# | d# | | | | a# |
| g# | 3# | c# | | | | g# | a# |
| f# | 3# | | | | f# | g# | a# |
| e# | 3# | | | e# | f# | g# | |
| d# | 3# | | d# | e# | f# | | |
| c# | 3# | c# | d# | e# | | | |
| e | 3b | cb | db | | | | ab |
| d | 3b | cb | | | | gb | ab |
| c | 3b | | | | fb | gb | ab |
| a | 3b | | | eb | fb | gb | |
| g | 3b | | db | eb | fb | | |
| f | 3b | cb | db | eb | | | |

FIG. 18
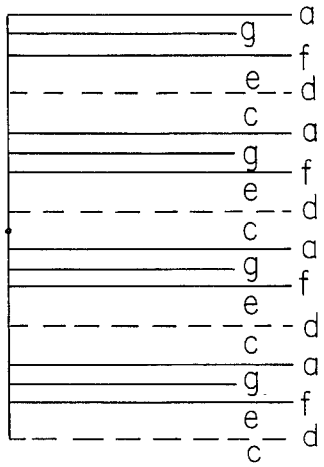
FIG. 19
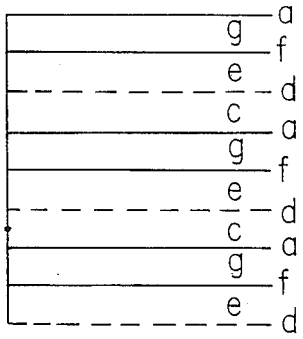
FIG. 20
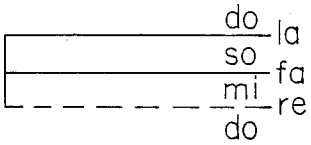
FIG. 21
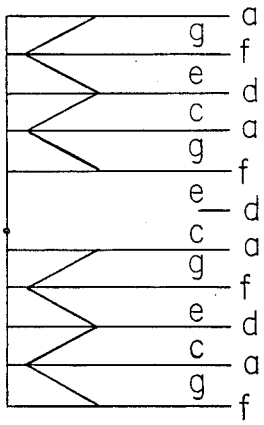
FIG. 22
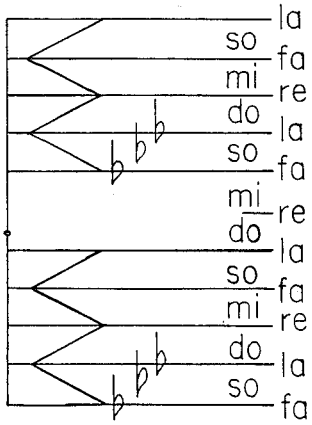
FIG. 23
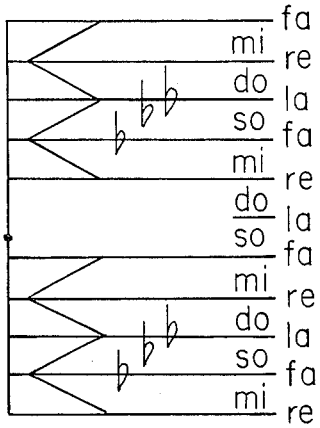
FIG. 24
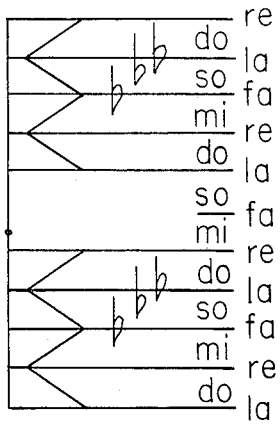
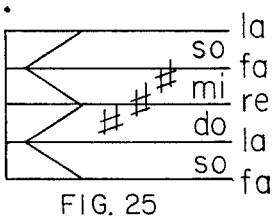
FIG. 25
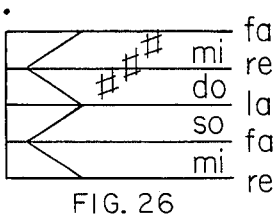
FIG. 26
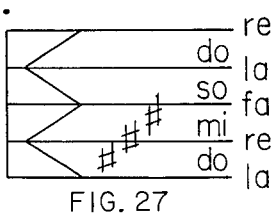
FIG. 27

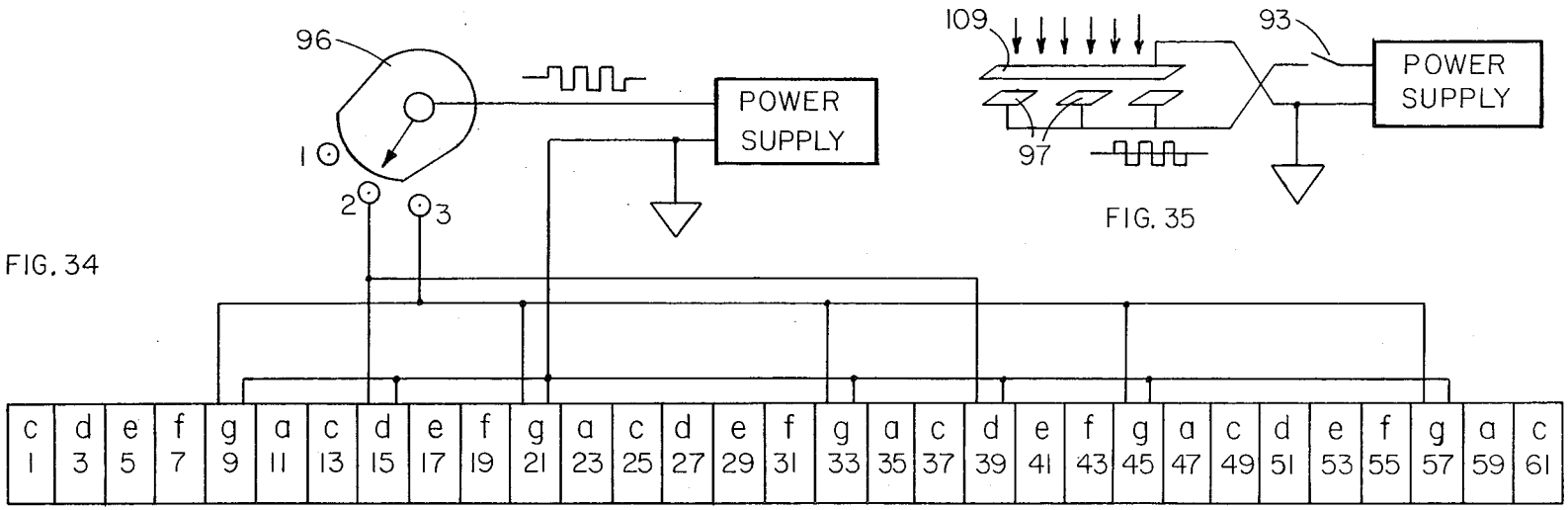
FIG. 34
FIG. 35
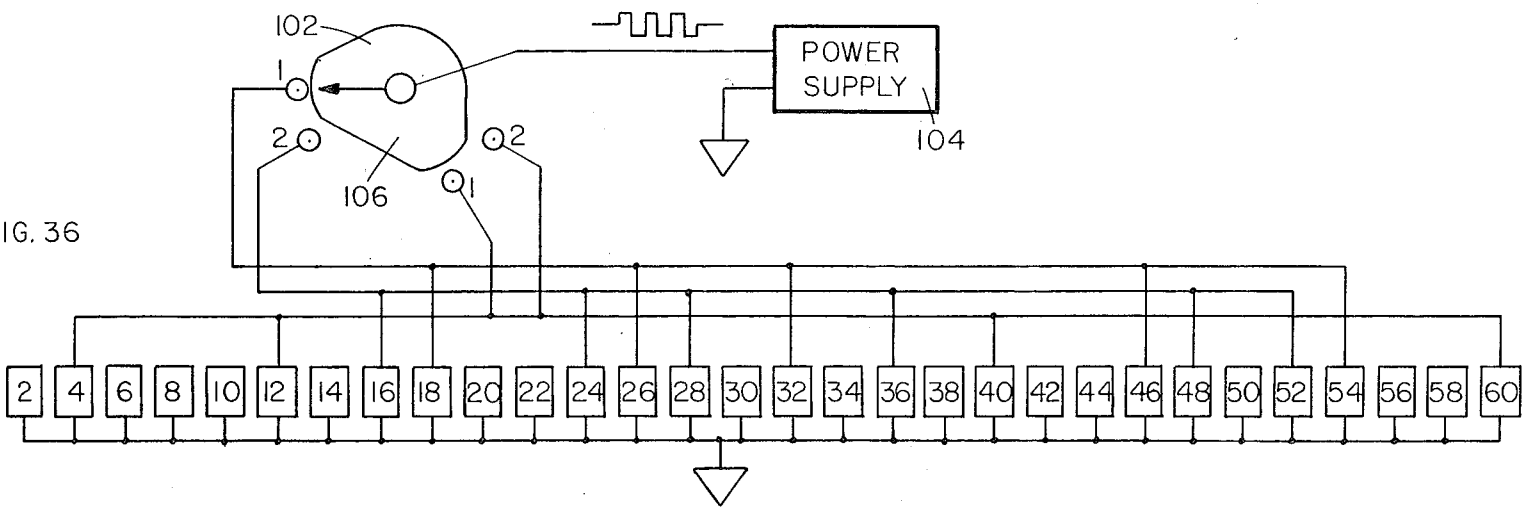
FIG. 36

ELECTRONIC MUSICAL INSTRUMENT

BACKGROUND OF THE INVENTION

1. Field of the Invention

The keyboard of a musical instrument is provided with two sets of landmarks to guide the playing of music written with different notations. The apparatus comprises electronic switching circuitry for selecting different musical scales and for actuating different key signatures for the different scales.

2. Description of the Prior Art

The musical keyboard is a heritage of the slow historical development of music itself. The traditional keyboard, like the traditional musical notation, is structured so as to facilitate performance of music in the diatonic key of C major. For learning and performing keyboard music, it has been truly helpful to have a keyboard whose structure conforms to our system of music notation. However, it has been apparent for some time that music—its enjoyment, performance, and composition-,—are unnecessarily hindered by the traditional system of notation and its associated keyboard.

The traditional way of writing music, used by Guido of Arezzo as early as the eleventh century, is to position symbols on a staff consisting of horizontal lines. The seven tones of the diatonic scale are now represented by notes on the lines and spaces of a five-line staff. Interspersed tones of the chromatic pentatone are referred to the basic notes of the diatonic scale by means of sharp or flat symbols which serve as tone corrections to the basic diatonic tones. Thus a chromatic tone intermediate to the C and D tone is represented by C♯ or D♭.

As early as the fifteenth century, keyboard instruments have played the diatonic scale on the front digitals of the keyboard and tones of the chromatic pentatone on back digitals. At that time it was very helpful to have a keyboard on which the wide front digitals played the most commonly-used tones in the key of C. And it is a considerable advantage to have a system of notation embodying those musical intervals that are most naturally sung and most easily identified. The major mode of the diatonic scale starts with the C tone, played on a C front digital. The succeeding D,E,F,-G,A,B tones are played on the succeeding D,E,F,-G,A,B front digitals.

For a diatonic musical composition to be written without the use of sharp or flat symbols, it must be written in the key of C. Such a restriction severely limits the choice of a modern composer, for he probably wants to base his composition on a tonic above or below the C tone. This is no problem for musical instruments having pitch changers, but many musical instruments do not have pitch changers. So composers and their publishers resort to a rather unsatisfactory method for specifying the absolute pitch of their diatonic scale; they start the major mode of their diatonic scale on some other note than C. This method requires that one or more of the seven basic diatonic tones be corrected by means of a sharp or flat symbol. The composer finds it convenient to specify the diatonic tone corrections by a key signature that is placed at the front of each line of written music. Key signatures greatly reduce the effort needed to make the diatonic tone corrections.

In the case of a keyboard player, the diatonic tone corrections require playing of the back digitals. This detracts from the former virtue of the traditional keyboard, of providing wide front digitals for the most commonly used tones. Furthermore, after learning to play a musical composition in one key, a keyboard musician finds that playing the composition in a different key requires quite different fingering. Inexperienced keyboard players have difficulty remembering and playing all the sharps or flats called for in the diatonic key signatures.

To alleviate these difficulties, a keyboard instrument can be provided with a device to physically actuate the tone corrections specified in the key signature. Such a device, which I call a key signature actuator, was disclosed by Martin Philipps in 1886 (U.S Pat. Nos. 354,733 and 519,071). If, for example, the device was set for a key signature with one sharp, then the F front digital would play not the F tone, but the F♯ tone instead, as called out in the key signature. This mechanical type of key signature actuator has not been widely used because of its complexity and expense.

Electrical versions of a key signature actuator have been described by Cornelius in U.S. Pat. No. 2,484,930 and by myself in U.S. Pat. No. 3,986,422. These key signature actuators provide two extra back digitals per octave span (F♭ and B♯). The F♭ back digital serves to play the F natural tone when the F front digital is playing the F♯ tone. The B♯ back digital serves to play the B natural tone when the B front digital is playing the B♭ tone.

Including these two extra back digitals, my keyboards have seven back digitals and seven front digitals per octave span, the back digitals alternating regularly with the front digitals throughout the keyboard. Seven consecutive front digitals play the diatonic scale. Also, in my earlier invention, seven consecutive back digitals play a diatonic scale based half an octave higher (or lower), and positioned half an octave higher (or lower) on the keyboard.

Key signature actuators such as these greatly reduce the difficulty of playing music, because the musician need not constantly remember the sharps or flats called out in the key signature. The mechanical difficulty of playing in other keys than C is also avoided, because all the most frequently used tones are now played entirely on the wide front digitals of the keyboard. Furthermore, once a musical composition has been learned in one key it can be played in any other key with exactly the same fingering.

It happens that this even keyboard construction for an improved diatonic key signature actuator is also suitable for playing music in improved notations. For example, the front digitals of the keyboard may be connected to play a whole-tone scale, with the back digitals playing the whole-tone scale a semitone higher (or lower). In this condition, any chord may be played at six pitches within the octave with the fingers held rigidly. The same chord can be played at the other six pitches in the octave with the fingers held rigidly in a second position. In the same way, any musical composition can be played with only two different fingerings. This whole-tone connection for the keyboard is well suited to the playing of music written in improved notations. An electrical organ that can play either the diatonic scale or the whole-tone scale on its front digitals was disclosed in 1964 in my U.S. Pat. No. 3,141,371.

For easier learning and playing of music, a good system of music notation makes use of the Guidonian hexachord scale, which is rich in the musical intervals of fifths, fourths, and minor thirds. These intervals are lacking in the whole-tone scale. The hexachord scale is simply the first six tones of the diatonic scale. Musical notation using this six-tone scale allows an intimate relationship between the appearance of written music and the sounds of music. To permit the hexachord notation to be used for instruments without pitch changers, I have devised a system of twelve hexachord key signatures which is very easy to learn and to use when playing.

Even so, my U.S. Pat. No. 3,986,422 describes a hexachord key signature actuator for the keyboard. This can be set to physically actuate any one of the twelve different hexachord key signatures, so that a tonal hexachord scale in that key will be played entirely on the front digitals of the keyboard. At the same time the back digitals will play an associated "chromatic" hexachord based half an octave higher.

The associated "chromatic" hexachord scale on the back digitals is displaced either five or seven digitals to the right of its associated tonal hexachord scale on the keyboard, depending on whether the key signature is written with flats or sharps.

When a six-tone scale is to be played on the front digitals, the diatonic key signature actuator must be disabled by manually setting it to the key of C. Similarly, when the front digitals are to play the diatonic scale it is necessary to manually set the hexachord key signature actuator to the key of c.

For compatibility with the traditional notation, I notate the hexachord scale on two five-line staffs like the treble and bass staffs of traditional notation. Lines representing these staffs are marked on the front digitals of the keyboard. The provision of dual key signature actuators has made it practical for a person trained in the six-tone notation to play music written in the traditional notation. However, the prior key signature actuators and scale changer have added substantially to the cost of the keyboard.

One reason that improved systems of notation and keyboard structures have not been widely adopted is that the amount of music written in any modernized notation is very small compared to the enormous store of musical literature written in the traditional notation, so that a child trained in a modernized notation will at the present time be severely limited if he cannot play music written in the traditional notation. Moreover, teachers are unwilling to train children in a new music system when suitable keyboards are not readily available. Even though a few keyboards exist conforming to an improved notation, they cannot easily be played by people already trained on the traditional keyboard, including the teachers themselves.

SUMMARY OF THE INVENTION

An electrically-keyed musical instrument has a double-row keyboard in which back digitals alternate with front digitals throughout the keyboard. The keyboard is provided with two sets of landmarks to assist playing from either the traditional notation or a six-tone notation. For compatibility with the traditional notation, the six-tone notation uses two five-line staffs like the treble and bass staffs of the traditional notation. The musical instrument has an electronic key signature actuator apparatus which may be set to physically actuate any key signature of music written in the traditional notation, so that the diatonic tones in the selected key can be played entirely on the front digitals of the keyboard. The other five tones of the chromatic scale must be played on back digitals of the keyboard. The electronic apparatus also allows the front digitals to play the whole-tone scale or a hexachord scale, and to play the hexachord scale in any selected one of twelve different hexachord keys.

A person trained on the instrument in a six-tone notation can, by throwing a switch, use his accustomed landmarks to play music written in the traditional notation. Furthermore, musicians trained in the traditional system can use *their* accustomed landmarks to play music written in the traditional notation, or by throwing a switch, in the six-tone notation. The practicality of switching back and forth between the two notations is greatly helped by the electronic key signature actuator apparatus.

An object of my invention is to construct a musical instrument that can play music written in a six-tone notation yet is easily played by musicians accustomed to the traditional notation and keyboard.

A second object of my invention is to construct a musical instrument in which scale changers and key signature actuators are electronically interlocked for convenience of operation.

A third object of my invention is to construct a musical instrument that is economical to manufacture and to maintain.

BRIEF DESCRIPTION OF THE DRAWINGS

FIGS. 1 and 2 are block diagrams of my musical instrument and of its electronic key signature actuator unit.

FIGS. 3 and 4 show diatonic key signatures for the keys of F and D.

FIGS. 14A, 14B, 15, and 16 are block diagrams of the musical scale changer section and one of its subsections, and a mode switch.

FIG. 17 is a table of tone substitutions for hexachord key signatures.

FIGS. 18 and 19 show staff notations for music.

FIG. 20 shows a three-line staff for teaching sight singing to children.

FIG. 21 shows five-line staffs for six-tone notation.

FIGS. 22–27 show hexachord key signatures.

FIGS. 34 and 35 diagram control circuitry for keyboard displays.

FIG. 36 diagrams control circuitry for a second embodiment.

DESCRIPTION OF THE PREFERRED EMBODIMENT

My musical instrument is conveniently divided into four units, as shown in FIG. 1. Referring to FIG. 1, status signals from the keyboard to the tone actuators are intercepted and guided by the electronic key signature actuator unit.

Figure 5:
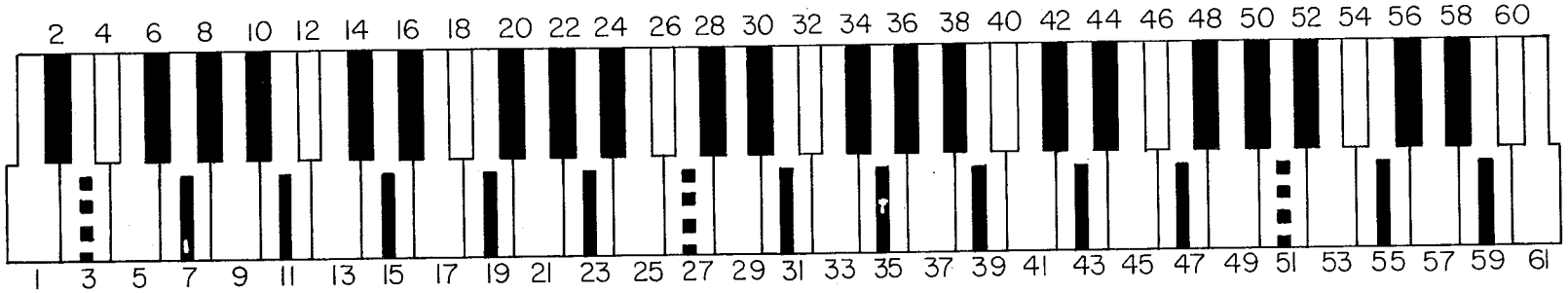
FIG. 5 shows the even keyboard of my musical instrument.

The keyboard has thirty back digitals alternating with thirty-one front digitals, as shown in FIG. 5. These 61 digitals are numbered in sequence from left to right, the front digitals being odd numbered and the back digitals being even numbered. In order to ease playing by musicians accustomed to the traditional keyboard, the back digitals of my keyboard are shaded so as to exhibit a similar appearance to the traditional keyboard, having groups of three black digitals alternating with groups of two black digitals. Between consecutive groups of black digitals is a single back digital shaded white. These white digitals are not used when the apparatus is set for the diatonic key of C. The width of the front digitals is equal to that of the front digitals in a traditional keyboard.

Referring again to FIG. 1, methods for constructing a sequence of sixty-three tone generators are well known. The tone generators have a musical interval of a single semitone between consecutive members of the sequence. In order to play the whole-tone scale on the front digitals, my instrument uses five octaves of tone generators running from C to C. In order to accommodate the hexachord scale in all keys, it is necessary to add two more tones so that the sequence of tones runs five octaves from C♭ to C♯.

Tone actuators turn the tone generators outputs on and off and feed them through a busbar to an amplifier and loudspeaker. Methods for constructing tone actuators, amplifier and loudspeaker are well known.

Traditionally, keyboard music is written on two five-line staffs, as shown in FIGS. 3 and 4. Referring to FIG. 3, the top line of the upper staff is nominally six spaces above the top line of the lower staff. Consequently, for a six-tone scale the positioning of tones in the upper staff is the same as the positioning of octave-related tones in the lower staff.

Unfortunately, the traditional notation is based on a seven-tone scale, so that positioning of tones on the upper staff is *different* from that on the lower staff. For example, the G tone is positioned on the first line of the lower (bass) staff, while it is positioned on the second line of the upper (treble) staff. Even more unfortunately, the G tone is also positioned in the *spaces* of both staffs. (Because seven is an odd number.) This changing appearance of tones on the staffs prevents an intimate relationship between the sounds of music and their appearance on the written page.

Further difficulties are caused by the diatonic key signatures used in the traditional notation. For example, a simple key signature consisting of a single flat symbol is illustrated in FIG. 3. Referring to FIG. 3, the flat symbol on the center line of the treble staff specifies that the B♭ tone is to be substituted for the B tone. The substitution results in the diatonic scale moving from the key of C to the key of F. In this key the scale is played on a traditional keyboard by six front digitals and one back digital (F-G-A-B♭-C-D-E). In the bass staff, the key signature must be shown on the *second* line.

A key signature for the key of D is shown in FIG. 4. Referring to FIG. 4, sharp symbols on the fifth line and third space of the treble staff specify that the F♯ and C♯ tones are to be substituted for the F and C tones respectively. These substitutions have the result of moving the diatonic scale up two semitones to the key of D.

These two key signatures and twenty-four others can be physically actuated by my key signature actuator unit. This feature of my invention greatly simplifies the learning and playing of music written in the traditional notation. Another feature of my invention provides for playing music written in an improved notation based on a six-tone scale.

In order to be compatible with the traditional notation, my improved notation uses two five-line staffs like the treble and bass staffs of the traditional keyboard notation. As described in my U.S. Pat. No. 3,986,422, the two five-line staffs are marked on the front digitals of the keyboard.

Heretofore, my improved notation has not been widely accepted, an important reason being that musicians already trained in the traditional system would need to use the new set of landmarks on the front digitals, rather than their accustomed landmarks consisting of alternating groups of two back digitals and of three back digitals. The keyboard of my present invention provides these mature musicians with their accustomed landmarks, as shown in FIG. 5.

Referring to FIG. 5, the back digitals are shaded white and dark in a repetitive pattern with a repetitive period of seven back digitals, the pattern repeating itself twice within the group of twenty-one back digitals in the range from digital 6 to digital 46 inclusive. An octave of the pattern, starting with digital no. 6, consists of three consecutive dark back digitals followed by a central single white back digital, followed by two consecutive dark back digitals followed by a final single white back digital.

The pattern of landmarks on the front digitals centers on front digital no. 27, which plays the tone of middle C. This central front digital, which is to the immediate right of a central single white back digital, may be pure white itself, or it may be marked, for example, by a dotted line as in FIG. 5. To represent the bass and treble staffs there are five marked front digitals on each side of the central front digital, the marked front digitals being separated from each other and from the central front digital by single unmarked front digitals. Dark marks on front digitals Nos. 31, 35, 39, 43 and 47 correspond to the treble staff of traditional notation. Dark marks on front digitals Nos. 3, 27, 51, 55 and 59 correspond to ledger lines of the traditional notation.

I have found that this second set of landmarks does not interfere with the ability of people to play music written in the traditional notation. Indeed, the markings are a considerable aid to inexperienced players learning the traditional music. In addition, the markings on the front digitals serve even better as landmarks for music written in a six-tone notation. I have found that the white and dark shading of the back digitals shown in FIG. 5 does not interfere with the playing of music written in six-tone notation.

Each digital of the keyboard carries a single electrical switch, which closes when the digital is depressed.

Methods for constructing this type of keyboard are well known.

Figure 6:
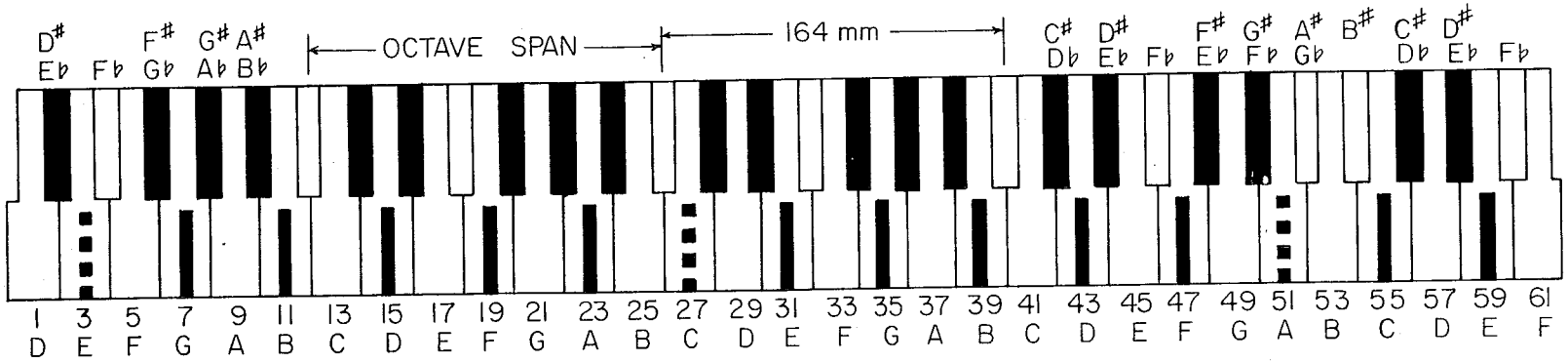
FIG. 6 shows my even keyboard with diatonic labeling of the digitals.

When electrical connections to the tone generators are such that the diatonic scale is played on the front digitals, the octave span includes seven front digitals and seven back digitals, as shown in FIG. 6. Referring to FIG. 6, the diatonic octave span of 164 mm is equal to that of the traditional keyboard. The sequence of thirty-one front digitals play those tones that constitute the diatonic scale. Specifically, the eight front digitals numbered 13 to 27 inclusive play eight tones spaced by interdigital musical intervals of 2-2-1-2-2-2-1 semitones. The tones played by the different digitals are shown for the standard case where the diatonic scale is played on the front digitals in the key of C. In this standard case the keyboard connections to the tone generators are as sketched in FIG. 7.

Figure 7:
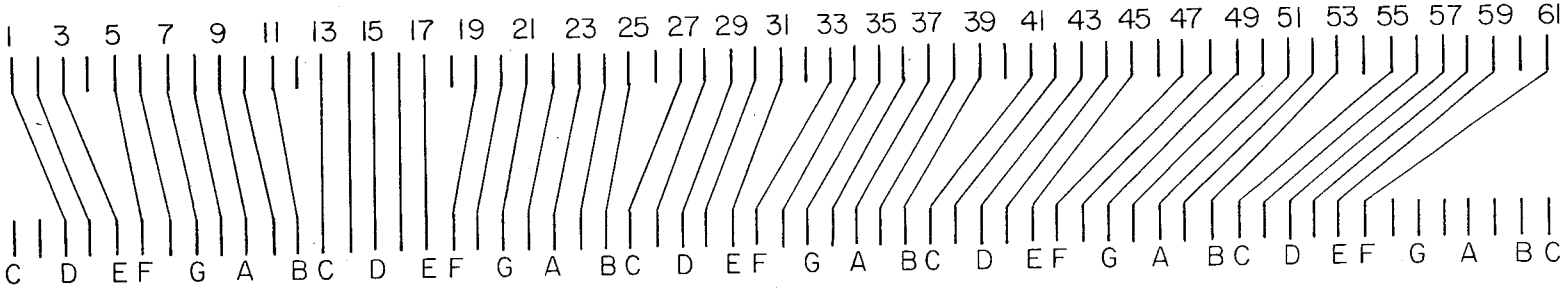
FIG. 7 diagrams connections between the keyboard and the tone generators when the keyboard is used to play the diatonic scale on its front digitals.

Referring to FIG. 7, since the extra F♭ and B♯ digitals are not used when playing in the diatonic key of C, the keyboard can play only four and a third octaves of tones, running from D to F.

Referring again to FIG. 1, the electronic key signature actuator unit is an important feature of my invention. In order to simplify description of this unit, it is separated into three sections as shown in FIG. 2. Each of these sections is further divided into subsections, and these are again subdivided. Key signature actuators differ from ordinary pitch changers in that they alter the interdigital musical intervals between the tones played by adjacent digitals.

Referring to FIG. 2, the three sections of this apparatus are electrically interlocked, so that the section labeled "DIATONIC KEY SIGNATURE ACTUATOR" can have no effect on the electrical connections to the tone actuators unless the apparatus is in its diatonic mode and the hexachord key signature actuator section is disabled. Similarly, the hexachord key signature actuator section can have no effect unless the apparatus is in its six-tone mode and the diatonic key signature actuator section is disabled. Output leads 62 from the diatonic key signature actuator section serve as input leads to the diatonic-to-whole-tone scale changer section. Output leads 63 from this scale changer section are input leads to the hexachord key signature actuator section. The whole-tone to hexachord scale changing operation and the hexachord key signature actuation are essentially the same operation. The diatonic key signature actuator section is diagrammed in FIG. 8.

Figure 8:
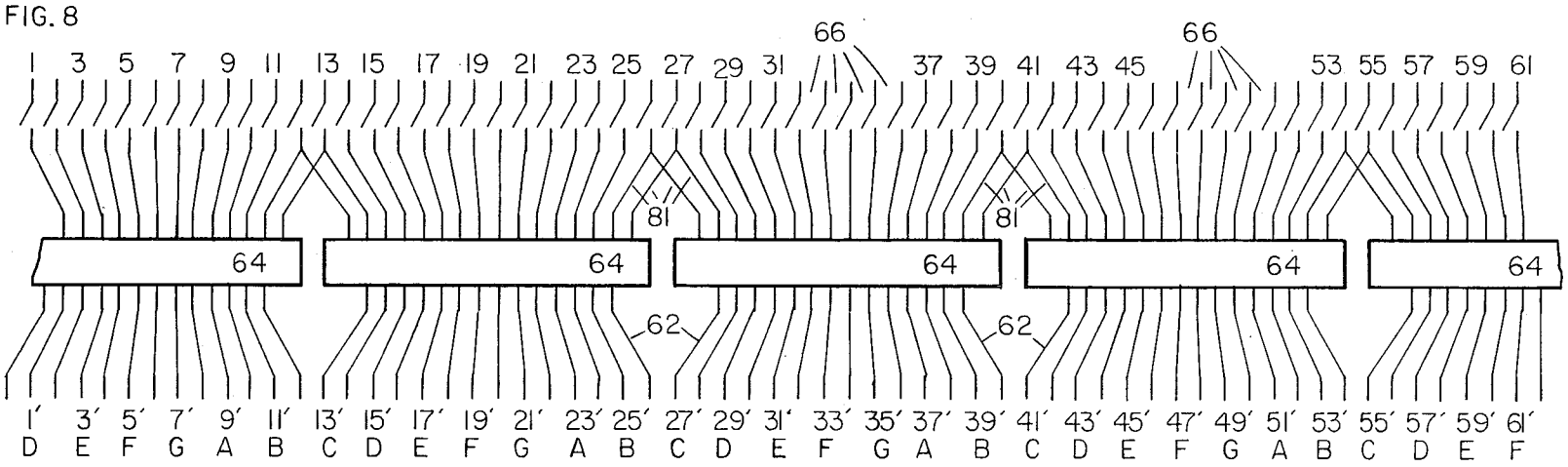
FIGS. 8 and 9 are block diagrams of the diatonic key signature actuator section and of one of its subsections.

Referring to FIG. 8, the five subsections 64 are identical. In the diatonic mode, each subsection connects a single octave of keyboard switches 66 to the tone actuators. In addition, a typical subsection receives two input signals from adjoining octaves of keyboard 66, so that it has sixteen input leads 81 feeding fourteen output leads 62. Only twelve of these output leads are used when operating in the diatonic mode. [The other two are needed when operating in the six-tone mode.] Output leads 62 are labeled according to their keyboard digital origins in the diatonic key of C and the tones played when the switching apparatus is operating in the diatonic mode. A block diagram of one of the subsections is shown in FIG. 9.

Figure 9:
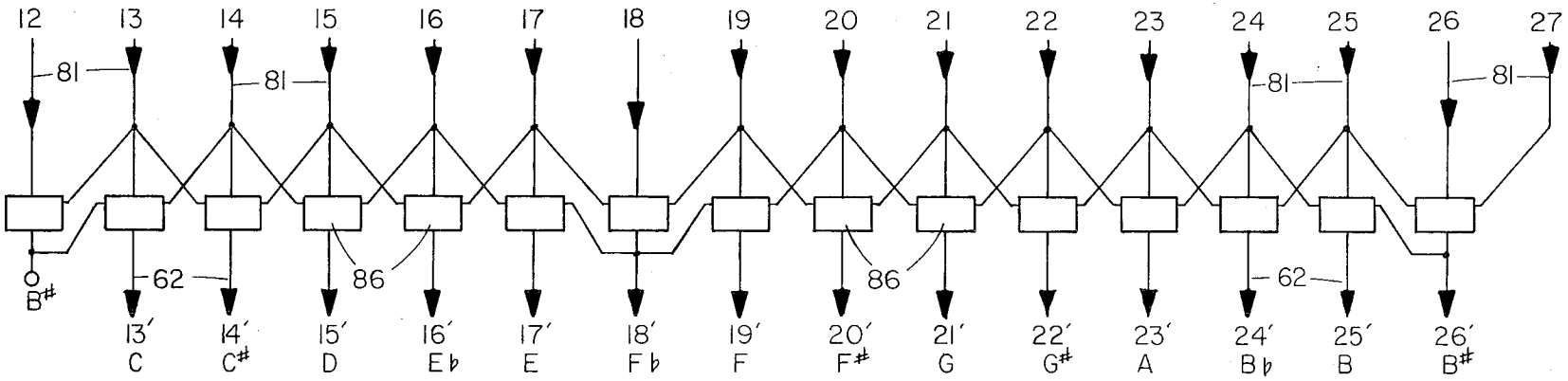
Figure 13:
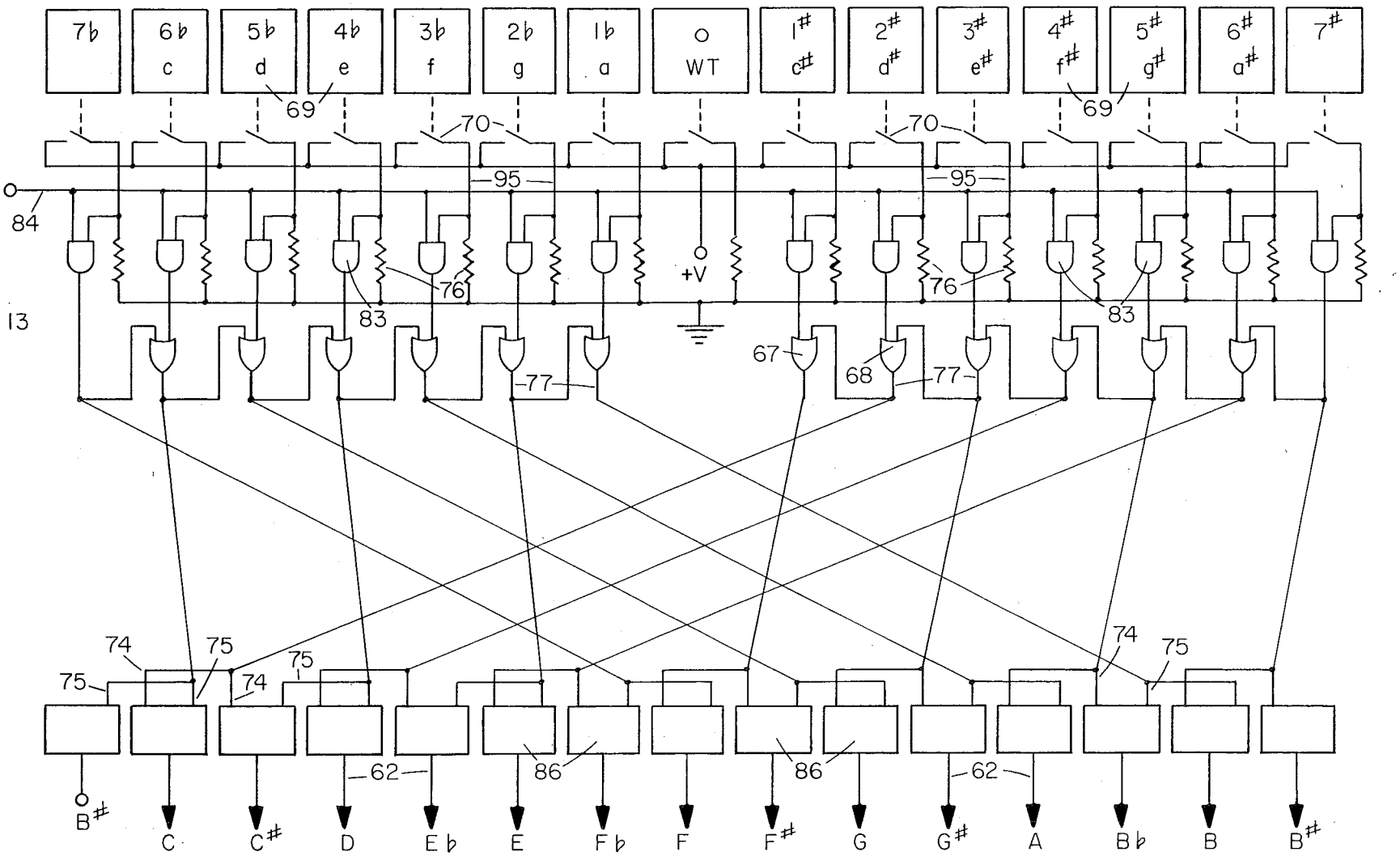
FIG. 13 shows control circuitry for the diatonic key signature actuator section.

Referring to FIG. 9, the output from each tone substitution module 86 follows the digital status signal from a selected one of three different keyboard digitals, depending on the setting of the manual control switches (shown in FIG. 13). For example, in FIG. 9 the output lead labeled 22' can contain the digital status signal from back digital number 22, or from a front digital numbered either 21 or 23, depending on the setting of the control switches.

In the diatonic standard state (key of C), each output lead carries the digital status signal from the input lead of the same label number, so that twelve keyboard digitals per octave span play their standard tones. In any keyshift state some digitals play tones which are shifted a semitone down (or up) from their diatonic standard tones.

In the special case of the substitution modules fed by the two extra back digitals per octave, labeled F♭ and B♯, the neighboring modules are fed from the substitution module outputs, rather than their inputs. This allows the F front digital to play the E tone, for example, as called out in the key signature for seven flats. Similarly, when the key signature actuator is set for six or seven sharps, the E front digital can play the F tone. All fourteen substitution modules 86 are identical. The circuitry of a typical one is shown in FIG. 10.

Figures 10, 11, 12:
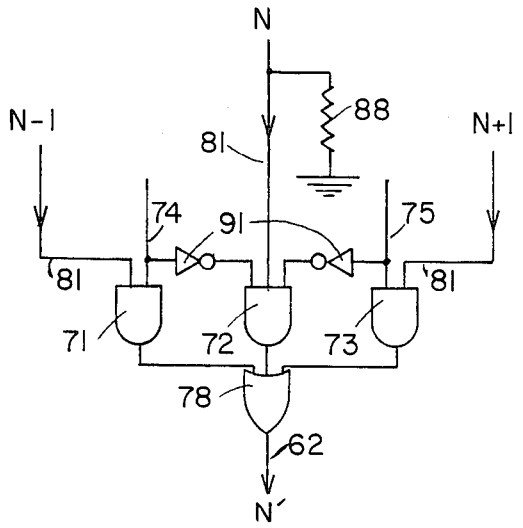
FIGS. 10 and 11 show an electronic tone substitution module and its truth table.
FIG. 12 is a table of tone substitutions for diatonic key signatures.

Referring to FIG. 10, AND gates 71, 72, 73 receive digital status signals on input leads 81 labeled N−1, N, N+1 respectively. If left and right enabling leads 74, 75 are low, then AND gates 71, 73 are disabled, and AND gate 72 is enabled. Thus the single output lead labeled N' contains the signal from its standard input lead labeled N, and the digital labeled N will play its standard tone.

If left enabling lead 74 is high, then output lead N' contains the signal from input lead N−1, gate 72 being disabled. If right enabling lead 75 is high, then output lead N' contains the signal from input lead N+1. This information is summarized in the truth table of FIG. 11, where a "zero" indicates low potential, a "one" indicates high potential.

Circuitry for control of the substitution modules is shown in FIG. 13. Referring to FIG. 13, control of both key signature actuators resides in the array of fifteen pushbuttons 69 together with their normally-open switches 70, switch output leads 95, and pull-down resistors 76. The top row of labels on pushbuttons 69 give the number of flats or sharps in the diatonic key signature to be actuated. The lower row of labels on pushbuttons 69 identify the buttons to play the whole-tone scale and to actuate the twelve hexachord key signatures.

When one of the pushbuttons 69 is depressed, it latches down and releases the pushbutton that was previously latched down. Interlocked pushbutton arrays of this type are well known. Switch output leads 95 are normally held at a low potential by pull-down resistors 76, but when a switch is closed its output lead is raised to the upper power supply potential V. When the switching apparatus is in its diatonic mode, lead 84 will be positive. Thus AND gates 83 will be enabled, so that a positive signal on one of switch output leads 95 can energize its corresponding one of output leads 77.

Although FIG. 13 shows substitution modules 86 for only one subsection, output leads 77 are connected also to the other four subsections of the diatonic key signature actuator.

Each one of output leads 77 could be used to switch the status signals from all keyboard digitals, but this straightforward arrangement would require more than 900 switch elements in the diatonic key signature actuator alone. Instead, in FIG. 13, each of output leads 77 affects directly only two status signals per octave. For example, depression of the pushbutton for the key of D (labeled 2#) activates OR gate 68, allowing the C# tone to get its status signal from the C front digital, and the C natural tone to be accessed by the B# back digital. Indirectly, OR gate 68 activates OR gate 67, which allows the F# tone to get its status signal from the F front digital, and the F natural tone to be accessed by the F♭ back digital.

As shown in FIGS. 6 and 7, for the key of C the eight front digitals numbered 13 to 27 play eight tones spaced by seven interdigital musical intervals of 2-2-1-2-2-2-1 semitones. In the key of D the same eight digitals play eight tones spaced by seven interdigital musical intervals of 1-2-2-1-2-2-2 semitones. In the keys of E,F,-G,A,B, the same eight digitals play tones spaced by the sequences of seven interdigital musical intervals of:

2-1-2-2-1-2-2 semitones,
2-2-1-2-2-1-2 semitones,
2-2-2-1-2-2-1 semitones,
1-2-2-2-1-2-2 semitones and
2-1-2-2-2-1-2 semitones respectively.

In all key signature actuated states, the number of playable back digitals per octave span continues to be five, with two back digitals per octave span that do not play any musical tone. For key signatures containing flats, all shifted tones are shifted downward by a semitone. For all key signatures containing sharps, all shifted tones are shifted upward by a semitone.

Tone substitutions specified by the fourteen traditional key signatures are shown in FIG. 12. The body of this table shows the tone substitutions specified for the front digitals shown at the top of each column. Key signatures are identified in the leftmost column. My diatonic key signature actuator can actuate any one of these fourteen key signatures so that all of its diatonic tones are played on the front digitals of the keyboard. Keyboard fingering of a musical composition will be exactly the same in all fifteen keys.

Output leads 62 from the diatonic key signature actuator section serve as input leads to the diatonic-to-whole-tone scale changer section, whose block diagram is shown in FIG. 14.

Figure 14A:
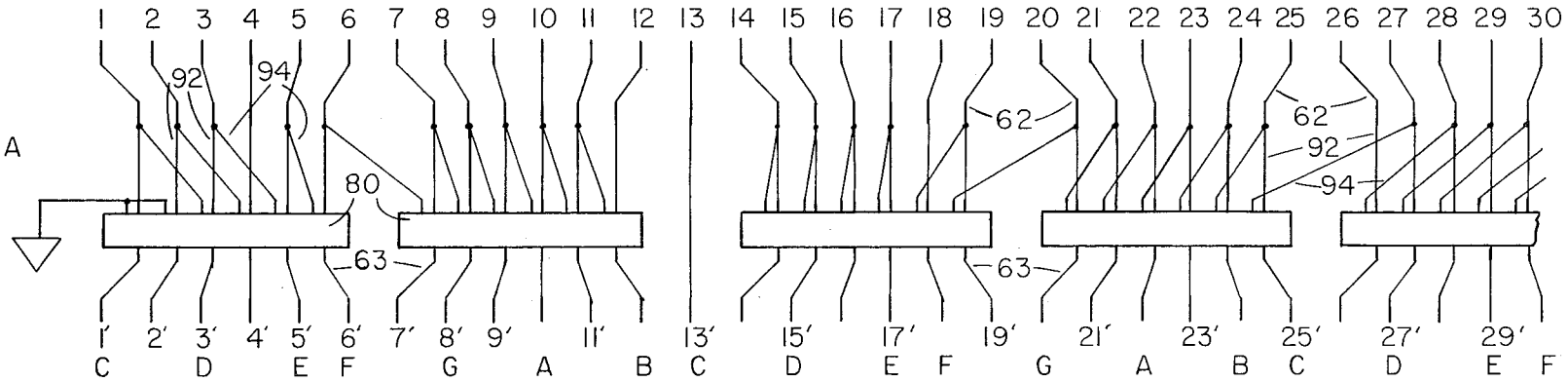
Figure 14B:
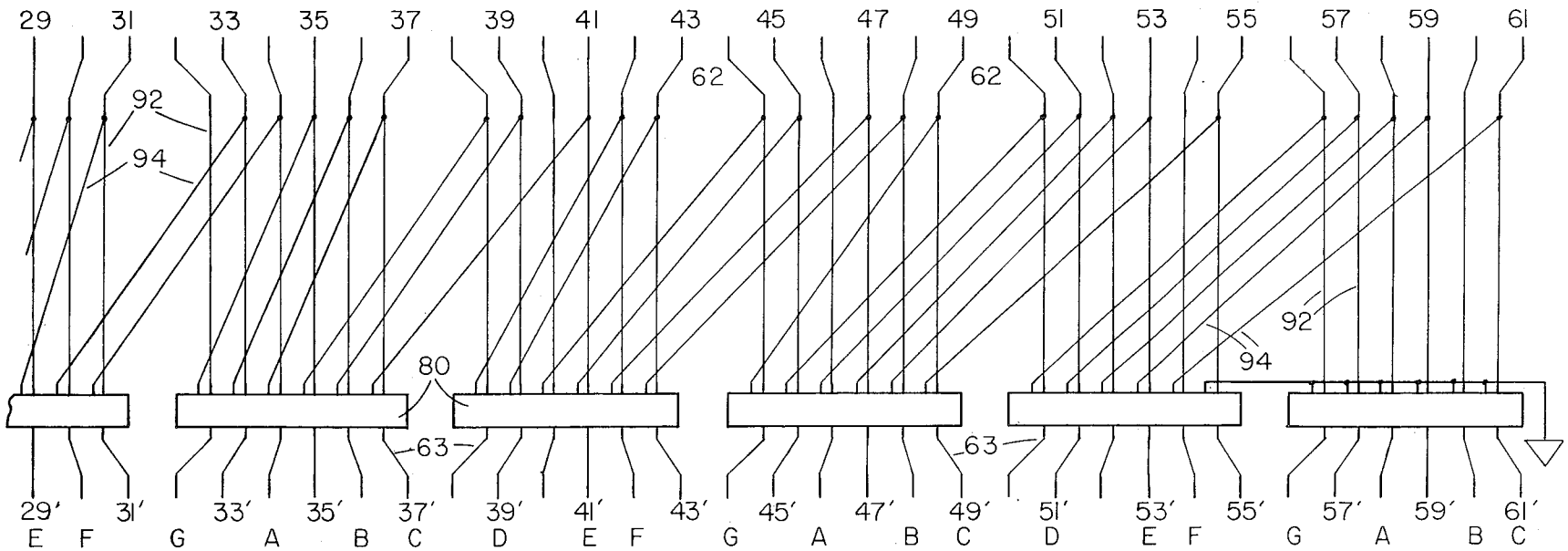

Referring to FIG. 14, in order to show clearly the input connections to the scale changer section, this diagram is broken into two parts as FIGS. 14A and 14B. The ten subsections 80 are identical to each other, except for their external connections. Each subsection 80 has twelve input leads and six output leads 63. Input leads 62 are numbered according to their keyboard digital origins when the diatonic key signature actuator is set for the key of C. Output leads 63 are labeled according to their digital origins when the apparatus is in its whole-tone state and the musical tones played when the hexachord key signature actuator is disabled.

The set of input leads 62 branches into two sets of input leads 92 and 94. The set 92 is connected so as to play a six-tone scale on the front digitals, while the set 94 is connected to play the diatonic scale on the front digitals. The particular ones of leads 62 which come from the extra back digitals F♭ and B# do not contribute to the set 94. For example, the input leads 62 from digitals number 4, 12, 18 and 26 do not contribute to any input lead of the set 94.

When the apparatus is set for the diatonic mode the keyboard can play only fifty-two tones, but when the apparatus is switched to the whole-tone state the keyboard can play sixty-one tones. The sequence of thirty-one front digitals then play those tones that constitute a whole-tone scale, any subsequence of seven consecutive front digitals playing seven tones spaced by interdigital musical intervals of 2-2-2-2-2-2 semitones. The switching apparatus mode switch is shown in FIG. 15.

Figure 30:
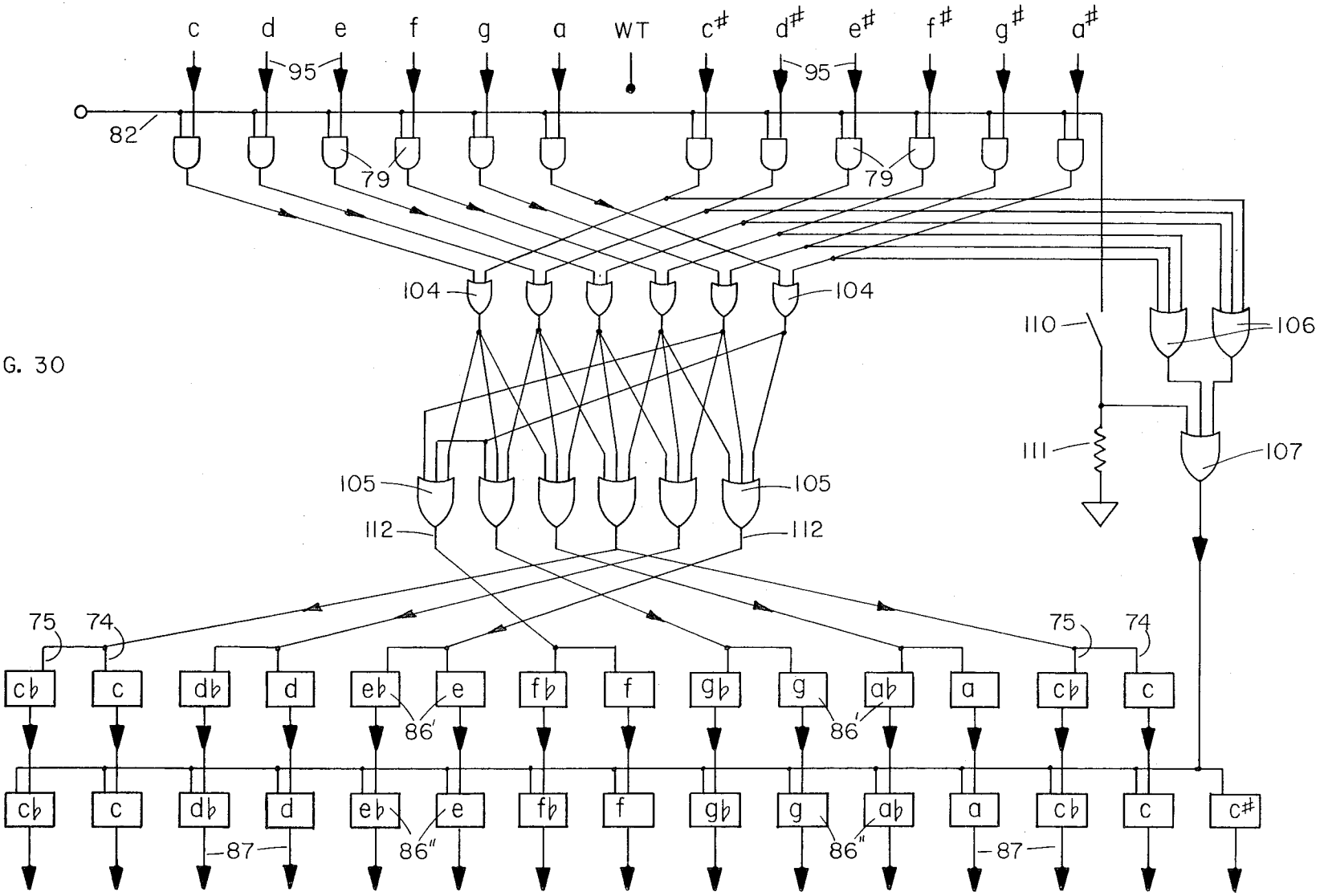
FIG. 30 diagrams control circuitry for the hexachord key signature actuator section.

Referring to FIG. 15, switch 85 selects between the diatonic mode and the six-tone mode of operation, enabling the appropriate key signature actuator section and disabling the inappropriate one. When lead 84 is high it enables an array of AND gates 83 in the diatonic key signature actuator (FIG. 13). When lead 84 is low, then lead 82 will be high. This enables AND gates 79 in the hexachord key signature actuator (FIG. 30). This electrical interlock automatically disables the hexachord key signature actuator when the diatonic key signature actuator is enabled, and it automatically disables the diatonic key signature actuator when the hexachord key signature actuator is enabled. When switch 85 in FIG. 15 is set for the six-tone mode of operation and the central pushbutton shown in FIG. 13 is depressed, then both the diatonic and hexachord key signature actuators are disabled. In this case any seven consecutive front digitals play the whole tone scale. Output leads 84 and 82 are common to all subsections 80 of the scale changer section. Circuitry for one of the scale changer subsections in shown in FIG. 16.

Referring to FIG. 16, if lead 82 is high, then a keyboard digital signal on a particular one of input leads 92 will be transmitted through AND gate 99 and OR gate 100 to its output lead directly below. On the other hand, if lead 84 is high, then that same output lead can receive its digital signal only from the input lead 94 to the immediate left of the particular one of leads 92.

Referring again to FIG. 14, input lead No. 13 is directly connected to the output lead labeled C. This has the result that the tone played by this digital is the same for the two modes of operation (assuming that both key signature actuators are in their standard states). For digitals to the left of digital 13, tones played in the diatonic mode are higher than those played in the six-tone mode. Thus, the tone played by digital No. 1 is C in the whole-tone state, D in the diatonic mode.

For digitals to the right of digital 17, tones played by a given digital in the diatonic mode are generally lower than those played in the six-tone mode. Thus the highest tone playable on the keyboard is C in the six-tone mode, but seven semitones lower at F in the diatonic mode. (Still assuming standard states for both key signature actuators.) Digital No. 27 plays middle C in the diatonic mode, middle D in the whole-tone state. This particular connection accommodates existing twelve-tone notation for the whole-tone state, in which the middle D tone has a special position.

A keyboard that plays the whole-tone scale on its front digitals was described in 1708 by Conrad Hanfling in Germany. Staff notations that conform to this type of keyboard have been described by many authors. A twelve-tone notation that uses four lines per octave is shown in FIG. 18; a notation that uses three lines per octave is shown in FIG. 19. In both notations, the distance between a dotted line and its nearest neighboring lines is equal to two semitones. These two notations are described in *Musical Six-Six Newsletter,* Issue 32 (1983), published in Kirksville, Missouri; Thomas S. Reed, Editor. Here the notation in FIG. 18 is named "Ling Lun" notation.

For compatibility with the traditional notation I usually write a six-tone notation on five-line staffs, as shown in FIG. 21. Referring to FIG. 21, the lines in a staff are all separated from each other by two semitones.

The signs at the front of the staffs are called scale signs. They announce that these five-line staffs carry *whole-tone* notation. A new system of nomenclature for the six tones of a whole-tone scale is shown in *lower case* letters. Intermediate tones are designated in the traditional way by means of flat or sharp symbols. The correspondence between the new nomenclature and the traditional one is shown in Table 1 for the same set of twelve musical tones.

TABLE 1

| | | | | | | | | | | | | |
|---|---|---|---|---|---|---|---|---|---|---|---|---|
| Whole-Tone | c | d♭ | d | e♭ | e | f♭ | f | g♭ | g | a♭ | a | c♭ |
| Dia-tonic | C | D♭ | D | E♭ | E | F | F# | G | G# | A | A# | B |

Figure 31:
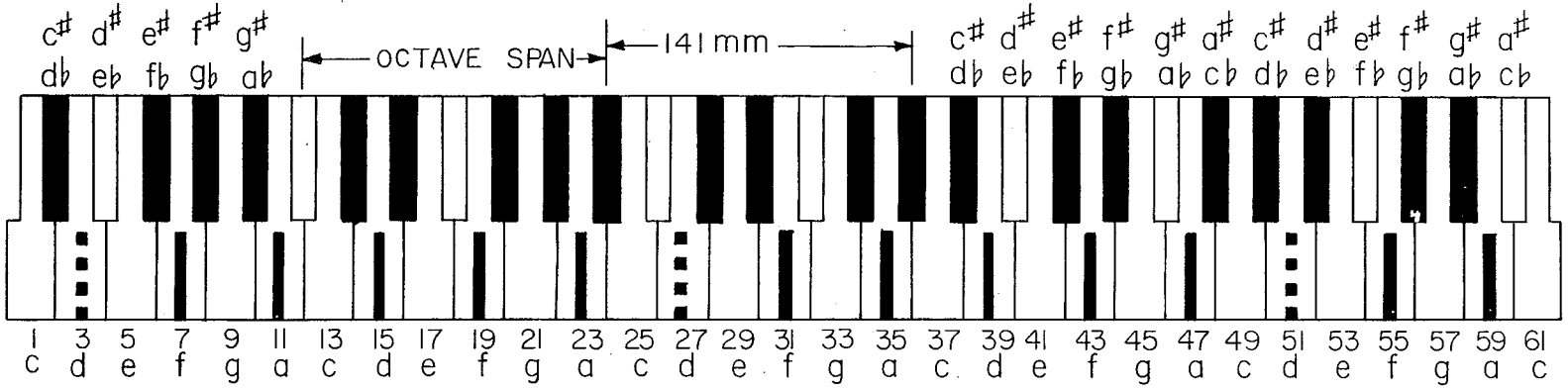
FIGS. 31–33 show mapping of five-line, three-line, and Ling Lun staffs onto the keyboard.

When my switching apparatus is set to play the whole-tone scale on the front digitals of the keyboard, the two groups of five black lines on the front digitals represent a mapping of the whole-tone staffs of FIG. 21. The whole-tone nomenclature applied to this mapping is illustrated in FIG. 31. Referring to FIG. 31, all digitals are labeled by the lower case letters used in whole-tone nomenclature. The octave span of 141 mm now includes only six front digitals.

The whole-tone arrangement of the keyboard is superior to the diatonic arrangement in some respects but inferior to it in other respects. The diatonic scale is rich in the musical intervals of fifths, fourths and minor thirds. On the other hand, a single whole-tone scale lacks these favorite musical intervals, so that they must always straddle the front and back rows of digitals of a whole-tone keyboard.

Referring to Table 1, it is seen that the first six tones of the diatonic scale (the hexachord) are expressed in my whole-tone notation as c-d-e-f♭-g♭-a♭. We say that, based on a whole-tone scale c-d-e-f-g-a, but flatting the last three tones, we obtain a hexachord scale in the key of "c". This scale conversion is represented by a hexachord key signature as shown in FIG. 22.

Referring to FIG. 22, the three flat symbols following the scale sign constitute a hexachord key signature for the key of "c". The first three tones do-re-mi of the hexachord coincide with the tones c-d-e of the whole-tone scale. The last three tones fa-so-la are notated as f♭-g♭-a♭.

In order to use the hexachord scale for instruments without pitch changers, it is necessary to be able to write the hexachord scale at other pitches. Going up four semitones, for example, a hexachord scale in the key of "e" is notated as shown in FIG. 23. Here the tones fa-so-la are notated as a♭-c♭-d♭. A hexachord scale still four semitones higher is notated as shown in FIG. 24. This scale may be said to be in the key of "g", since it starts on "g" in the whole tone notation. (This would be G# in traditional notation.)

Instead of obtaining a hexachord scale by flatting the last three tones of a whole-tone scale, the hexachord can be obtained by *sharping* the *first* three tones of the whole-tone scale. For example, the hexachord key signature for the key of c# is shown in FIG. 25. Signatures for the keys of e# and g# are shown in FIGS. 26 and 27. In all key signatures containing sharps, "do" is the lowest sharped note. In all key signatures containing flats, "do" is the next note above the highest flatted note.

A listing of the tone changes called out in all twelve hexachord key signatures is shown in FIG. 17. Comparing FIG. 17 with FIG. 12 for the diatonic scale, we see that whereas the diatonic key signatures contain from one to seven tone changes, the hexachord key signature always contains exactly three tone changes. These groups of three consecutive tone shifts are always at one of two positions relative to the key tonic. As a result, this system of twelve hexachord key signatures is easy to learn and to remember.

Inspection of FIGS. 22–27 shows that, for these six key signatures, spaces of the staff always correspond to the tones do-mi-so of a maJor triad based on the tonic "do" of the hexachord major scale. The lines always correspond to tones re-fa-la of a minor triad based on the tonic "re" of a hexachord minor scale. Learning to read music is greatly facilitated by this close correspondence between the sounds of music and their representation on paper (or on a teacher's display panel). Much of beginning music can be played and sung satisfactorily in one of these six hexachord keys.

When teaching children to sing by the "movable do" method, it is helpful to start with a single three-line staff, as shown in FIG. 20. Referring to FIG. 20, the lines and spaces of the staff are simply interpreted as the tones of a hexachord scale, with "do" immediately below the lowest line and immediately above the highest line. Reference to the whole-tone scale is best postponed.

Since the system of hexachord key signatures uses two six-tone scales (the hexachord and whole-tone scales), I call it "hexatonic notation". The whole-tone scale is considered to be the "hexatonic standard scale". The hexachord scale is specified by key signature deviations from the hexatonic standard scale.

On my keyboard, the notated whole-tone scale is considered to reside on the front digitals, as shown in FIG. 31. Accordingly, in the key of "c" the first three tones do-re-mi of the hexachord (or diatonic) scale are played as c-d-e on the front digitals of the keyboard; the next three tones fa-so-la are played as f♭-g♭-a♭ on the back digitals. For all six key signatures with flats the appearance of the written music will be the same and the fingering on the keyboard will be the same. The six key signatures with sharps require a different single fingering on the keyboard, and the appearance of the written music is slightly different from that using key signatures with flats.

In order to allow the most frequently used tones and musical intervals to be played on the wide front digitals of the keyboard, my electronic key signature actuator unit includes a hexachord key signature actuator section. Using this section, the hexachord scale in any one of the twelve keys can be played entirely on the front digitals of the keyboard, and the fingering will then be exactly the same for all twelve hexachord keys. A diagram of the hexachord key signature actuator section is shown in FIG. 28.

Figure 28:
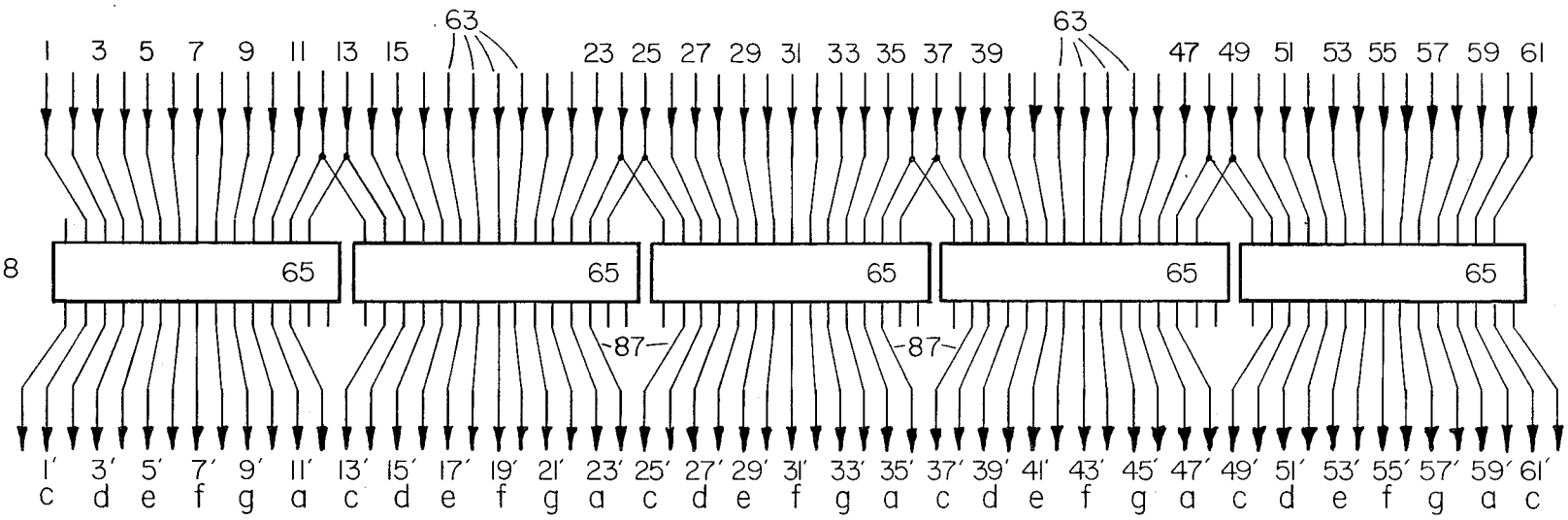
FIGS. 28 and 29 are block diagrams for the hexachord key signature actuator section and one of its subsections.
Figure 29:
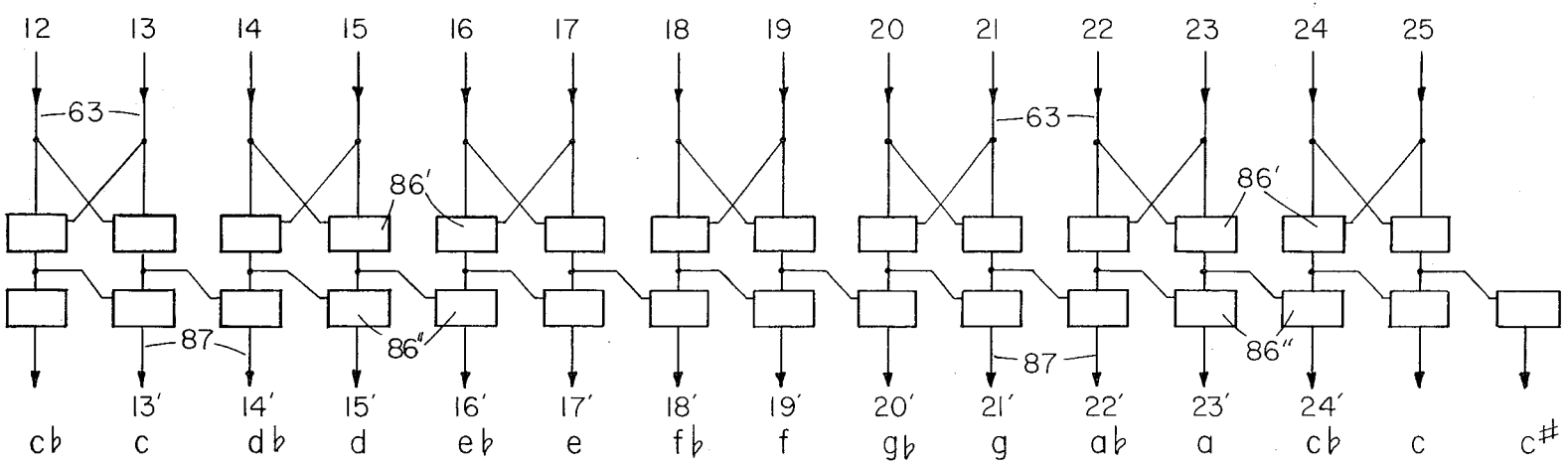

Referring to FIG. 28, the hexachord key signature actuator looks like the diatonic key signature actuator (FIG. 8), except that now the keyboard octave contains only twelve digitals, instead of fourteen. The five subsections 65 are identical to each other; each has fourteen input leads 63 and fifteen output leads 87. Input and output leads are labeled according to their keyboard digital origins when the apparatus is in its whole-tone state, and according to the musical tones played in whole-tone nomenclature. A typical subsection uses only 12 of its output leads. One of the subsections is shown in FIG. 29. ! Referring to FIG. 29, the substitution modules 86' and 86'' are identical to those used in the diatonic key signature actuator, as shown in FIG.

10, but the connections between adjacent modules are different from those for the diatonic key signature actuator. The upper row of modules 86' serve to interchange tones played by adjacent digitals. The lower row of modules 86" serve to raise the output pitch by a semitone. In the hexatonic standard state (whole-tone scale), each output lead 87 carries the digital status signal from the input lead 63 of the same label number, so that each keyboard digital plays its hexatonic standard tone. In any hexachord state, three front digitals per octave span play tones which are shifted a semitone from their hexatonic standard tones.

Circuitry for control of the hexachord key signature actuator is shown in FIG. 30. Referring to FIG. 30, input leads 95 are energized by the array of key selection pushbuttons, shown in FIG. 13. Input lead 82 is energized by mode switch 85, shown in FIG. 15. When the switching apparatus is operating in the six-tone mode, a positive potential on lead 82 enables AND gates 79, so that a pushbutton signal on one of input leads 95 can be transmitted to substitution modules 86' and 86". Although FIG. 30 shows substitution modules for only one subsection, output leads 112 are connected also to the other four subsections of the hexachord key signature actuator. Sharping switch 110 is left open for the preferred embodiment. The pushbuttons for the six key signatures of sharps make the same tone substitutions that do the pushbuttons for the six key signatures of flats, except that for the key signatures of sharps the musical output pitch is raised a semitone.

In FIGS. 10, 13, 15, 16, and 30, reference numbers represent commercial components as follows:

78, 105, 106, 107 represent OR gate CD4075,
67, 68, 100, 104 represent OR gate CD4071,
71, 72, 73, 79, 83, 98, 99 represent AND gate CD4081,
91, 103 represent inverter CD4049,
76, 88, 111 represent 30 Kilohm resistor.

The logic components are marketed by RCA.

When the hexachord key signature actuator is set for any one of the twelve hexachord keys, the front digitals of the keyboard will play a tonal hexachord scale. For example, when the "c" pushbutton shown in FIG. 13 is depressed, then the seven consecutive front digitals numbered 13 to 25 inclusive will play the primary tonal hexachord scale consisting of seven tones spaced by six spaced by interdigital musical intervals of 2-2-1-2-2-3 semitones. The primary tonal hexachord scale on the front digitals is derived from two wholetone scales by interchanging tones between front digitals 19, 21, 23 and back digitals 18, 20, 22 respectively. Consequently, the seven consecutive back digitals 18 through 30 inclusive will play a "chromatic" hexachord scale having exactly the same interdigital musical intervals as its associated tonal hexachord scale on the front digitals. The "chromatic" hexachord scale is positioned five digitals to the right of its associated tonal hexachord scale, and it is pitched six semitones higher.

Similarly, hexachord key signatures for the keys of d, e, f, g, a, derive five pairs of hexachord scales, each from two wholetone scales. When pushbuttons for the hexachord keys of d, e, f, g, a, are pushed, the same seven front digitals 13 through 25 will play seven tones spaced respectively by the sequences of six interdigital musical intervals:

3-2-2-1-2-2 semitones,
2-3-2-2-1-2 semitones,
2-2-3-2-2-1 semitones,
1-2-2-3-2-2 semitones,
2-1-2-2-3-2 semitones.

FIG. 30 shows the same interchanges between front and back digitals that were made in the hexachord key signature actuator described in my U.S. Pat. No. 3,986,422 for the six hexachord key signatures containing flats. Consequently, a musical composition will have the same fingering on the keyboard for all of these key signatures containing flats. On the other hand, in U.S. Pat. No. 3,986,422, actuated hexachord key signatures containing sharps produce a different fingering from those containing flats, because with sharps each chromatic hexacahord is spaced seven digitals to the right of its associated tonal hexachord, rather than five digitals to the right.

The construction shown in FIG. 30 avoids this shift of the chromatic hexachord, so that fingering of a musical composition will be exactly the same in the primary hexachord key and the eleven secondary hexachord keys. This circuitry was chosen so as to position the chromatic hexachord scale five digitals (rather than seven) to the right of its associated tonal hexachord scale for all twelve hexachord keys.

When music is written with a hexachord key signature of flats, all accidentals should be written as either flats or naturals. When the music is written with a key signature of sharps, all accidentals should be written as either naturals or sharps. Then any accidental will be played on the back digital to the immediate left of its notated front digital, a musical composition being fingered exactly the same in all twelve hexachord keys.

For each tonal hexachord scale played on the front digitals, the intermediate tones played on the back digitals constitute a "chromatic" hexachord based five digitals higher on the keyboard. For example, for the tonal hexachord on the front digitals notated c-d-e-f♭-g♭-a♭, the chromatic hexachord played on the back digitals will be f-g-a-c♭-d♭-e♭. Indeed the chromatic hexachord is identical to the "tonic" hexachord that would be obtained on the front digitals by touching the "f" button in FIG. 13. In that case *its* chromatic hexachord would become the original hexachord c-d-e-f♭-g♭-a♭, but played on the back digitals.

Hexatonic notation has the advantage over diatonic notation of being a simpler representation of the sounds of music, of requiring fewer ledger lines, and of having key signatures that are much easier to learn and to remember. As played on my keyboard, the hexatonic system retains the virtue of the diatonic system—that in most music, and in any key, the most commonly used tones can be played on the wide front digitals of the keyboard.

In playing music written in either whole-tone or hexachord notation, the player orients himself by means of the markings on the front digitals, as shown in FIG. 31. FIG. 31 is the same as FIG. 6, except that the octave span now includes only six front digitals and the digitals are given my whole-tone labels. The five-line staffs shown in FIG. 31 now represent a mapping of the whole-tone staff notation.

When a person trained in the six-tone system wishes to play music written in the traditional notation, he throws the mode and key switches shown in FIGS. 13 and 15 and proceeds to play as before. He need not learn the old labels for the lines and spaces of the staffs. If he wishes, he can still mentally apply his accustomed labels to the lines and spaces of the staffs. Or he can disregard labels and simply play notes as digitals according to the mapping of the five-line staffs onto the keyboard.

When a musician trained in the traditional notation wishes instead to play music written in the six-tone notation, he throws the mode and key switches shown in FIGS. 15 and 13 and continues to play as before. He need not worry about the new labels applied to the lines and spaces of the staff. If he wishes, he can still mentally apply his accustomed labels to the lines and spaces of the staff and to the front digitals of the keyboard, and use his accustomed landmarks to play in his usual way. On the other hand, he can deemphasize labels in both traditional and six-tone notation, and play strictly according to the mapping of the five-line staffs onto the keyboard.

Although hexatonic notation is usually written for compatibility on five-line staffs, the simplest expression of hexatonic notation is on three-line staffs as in FIG. 19. Referring to FIG. 19, each "d" line is dotted to separate the octaves for easier reading. Alternatively, the "d" lines may be shown only as ledger lines.

I prefer to start music beginners on a single three-line staff as shown in FIG. 20. As the range of music expands to cover several octaves, it can be written on several three-line staffs juxaposed as in FIG. 19. For this music beginning stage I map the three-line staffs onto a vertical display panel and onto my keyboard, as illustrated in FIGS. 19 and 32.

Figure 32:
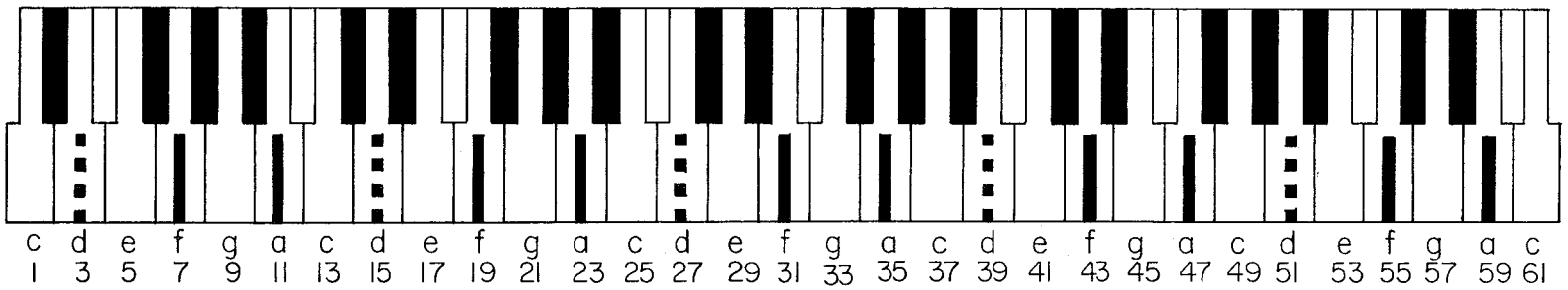

Referring to FIG. 32, the markings on all digitals are the same as in FIG. 31 except that the solid dark lines on digitals 15 and 39 are converted into dotted lines. The conversion is accomplished by activating two small light valve displays so that three dark colored squares on each digital are converted into light colored squares. Details of the display are shown in FIG. 35.

Referring to FIG. 35, ambient light from above enters a liquid crystal cell through transparent electrode 109. In the absence of an electric field, a "guest" dye within the liquid crystal absorbs the light so that the display appears dark.

When switch 93 is closed, an alternating square wave is applied to three reflecting electrodes 97. The electric field between the reflecting electrodes and the transparent electrode aligns the dye molecules with it, so that they don't absorb the incident light. The light is thus reflected upward from the reflecting electrodes and they appear white. This type of liquid crystal action is well known as the guest-host effect, the dye molecules being guests in the host liquid crystal.

To convert the markings on the digitals, a three-position switch is used, as shown in FIG. 34. Referring to FIG. 34, in position 1 of switch 96 no electric power is applied to the keyooard, so that it appears as shown in FIG. 31. In position 2 of switch 96, power is applied to the guest-host cells on digitals 15 and 39, so that the keyboard appears as shown in FIG. 32. This pattern represents a mapping onto the keyboard of the three-line notation shown in FIG. 19. After students have learned to read music written on a single three-line staff and then on multiple three-line staffs, the traditional five-line staffs can be reintroduced on the keyboard (and on the vertical display panel) by moving display switch 96 to its position 1 in FIG. 34.

Figure 33:
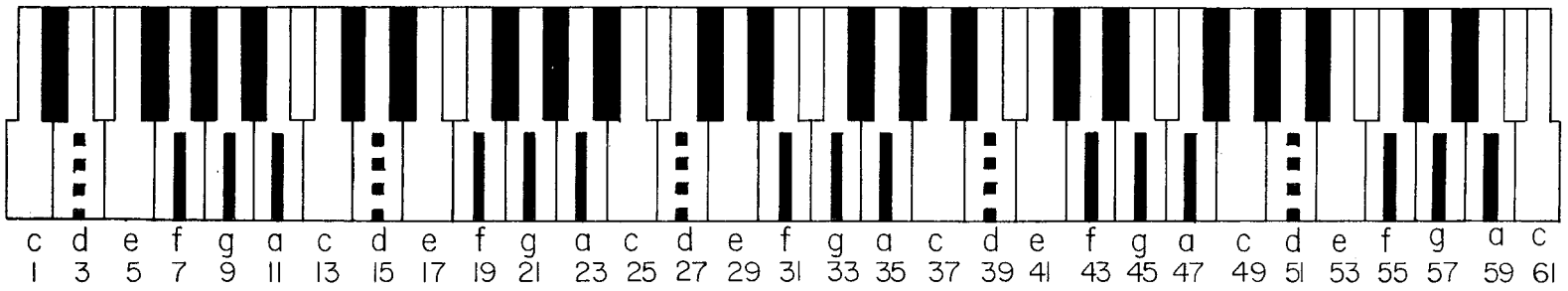

In position 3 of switch 96, power is applied to all the "g" digitals, so that dark lines appear on these digitals. Since power remains applied also to the two "d" digitals, the keyboard is now marked for twelve-tone notation as shown in FIG. 33. Referring to FIG. 33, the markings on the front digitals now map the Ling Lun staffs shown in FIG. 18. The dark lines showing on the "g" digitals are produced by liquid crystal cells utilizing the twisted nematic effect. Construction of this type of liquid crystal cell is well known, such cells being a common feature of digital watches and calculators.

A twelve-tone notation such as that shown in FIGS. 18 and 33 is most appropriate for complex music which does not have any well-defined key. For such music it is fitting to abandon flat and sharp symbols and to use a separate note for each tone of the twelve-tone scale. The proper keyboard arrangement has the front digitals playing one whole-tone scale and the back digitals playing another whole-tone scale. This connection is obtained by depressing the central pushbutton shown in FIG. 13 to disable the hexachord key signature actuator.

In interpreting twelve-tone notations for the keyboard, some musicians have preferred to make lines of a staff correspond to the back digitals, which are traditionally black. This interpretation of the staff lines is facilitated by a second embodiment of my invention.

A SECOND EMBODIMENT

In the second embodiment of my invention the front digitals of the keyboard are uniformly white and the back digitals are uniformly light gray. Marks to orient the player on the keyboard are provided by a light valve display positioned on a stationary surface immediately behind the back digitals. This display is made electrically changeable in order to provide landmarks for use with both the diatonic mode and the whole-tone state of my electronic switching apparatus. The tone switching apparatus is the same as in the preferred embodiment except that sharping switch 110 (shown in FIG. 30) is now closed. When the tone switching apparatus is operating in the diatonic mode the keyboard display appears as in FIG. 37.

Figure 37:
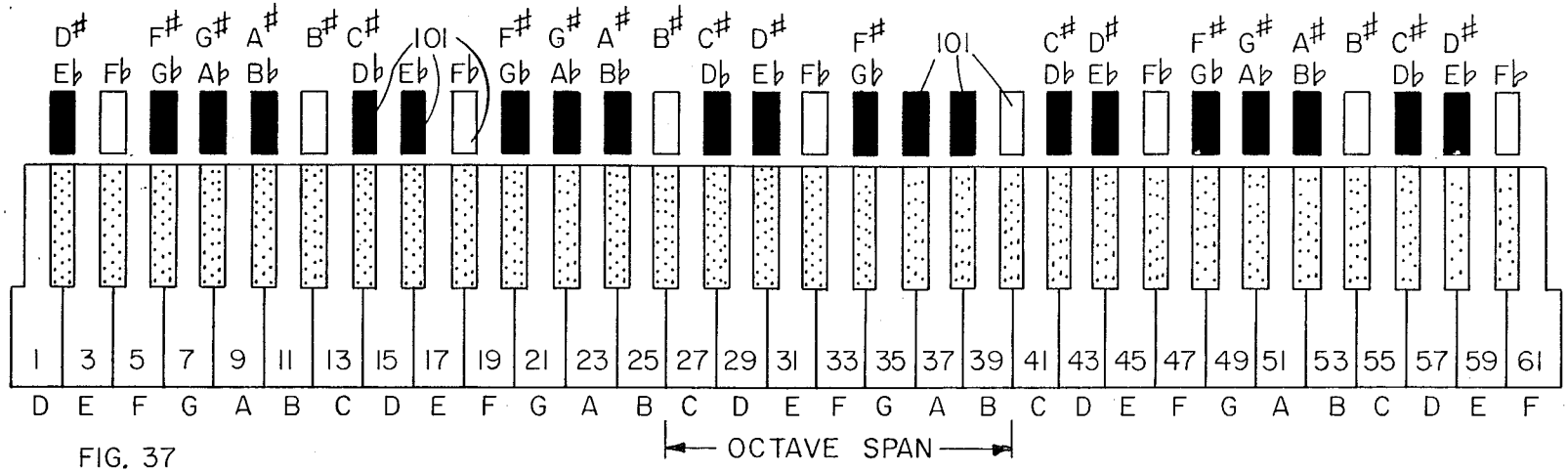

Referring to FIG. 37, the display consists of a linear array of liquid crystal cells 101 lined up with the back digitals. In the diatonic mode the display includes alternating groups of two and of three black markers, with a single white marker between successive groups of black markers. The pattern of black and white markers serves to orient players who are accustomed to the traditional keyboard, with its familiar groups of two and three black digitals. This repetitive pattern has a repetition period of seven back digitals.

Figure 39:
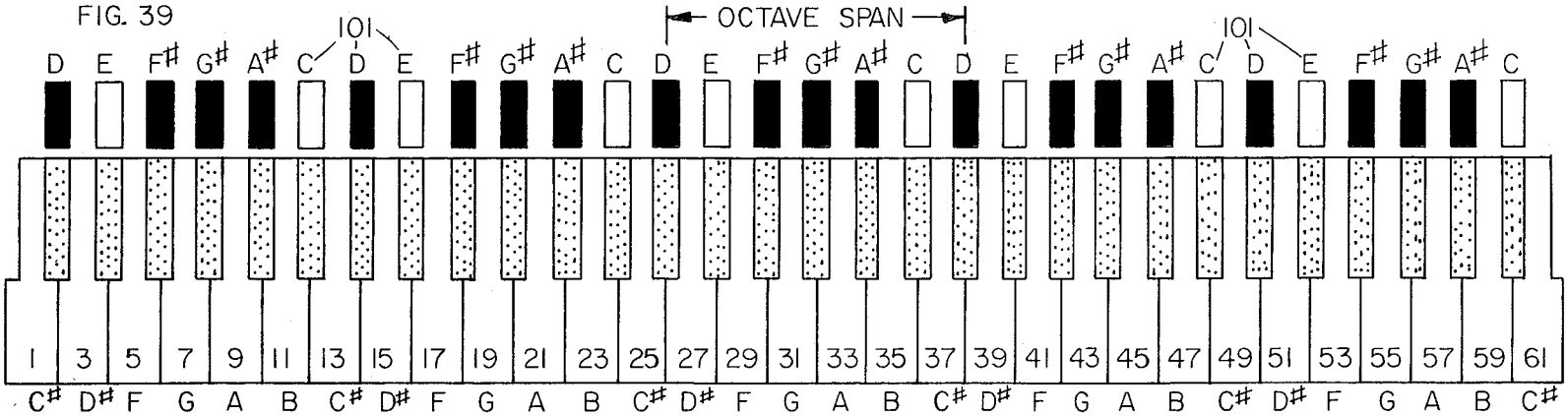

When the tone switching apparatus is operating in the whole-tone state, the display is changed to that shown in FIG. 39.

Referring to FIG. 39, markers 101 now constitute a repetitive pattern with a repetition period of six back digitals. The pattern includes a group of three black markers separated on each side from a single black marker by a single white marker. This pattern is intended to correspond to the Ling Lun notation shown in FIG. 18, with the "c" tones now played by back digitals. In FIG. 39, digitals are labeled according to the tones they play in traditional nomenclature, in order to demonstrate a resemblance in the grouping of seven of the twelve tones per octave in Ling Lun notation and in the traditional notation. Thus in FIG. 39 the group of seven digitals F, F♯, G, G♯, A, A♯, B (associated with three black markers) resembles the group of the corresponding seven digitals in FIG. 37. Indeed the two sets of digitals coincide in the digitals numbered 5 to 11.

This resemblance helps musicians who must play in both Ling Lun and traditional notations.

Figure 38:
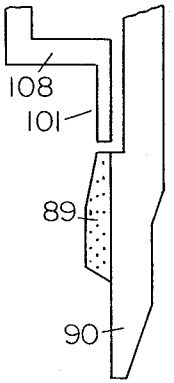
FIGS. 37–39 show keyboard displays for the second embodiment.

An end view of the keyboard display is shown in FIG. 38. Referring to FIG. 38, keyboard display 101 is supported by riser 108, at the same level as the back end of back digitals 89, and slightly above the level of the front digitals 90.

Riser 108 is faced with a mirror surface, so that the individual display cells appear to be twice as long as they really are. If unwanted reflections from the room intrude, then riser 108 may be covered with black velvet.

The liquid crystal cells 101 contain a pleochroic dye, like the cells shown in FIGS. 32 and 35, but in this second embodiment the liquid crystal becomes solid at room temperature. The reflective electrodes are electrically heated momentarily so that the crystal melts long enough to allow it to be whitened by the alternating square wave. After the cell cools, the alternating square wave can be deactivated and the solid crystal remains white. If an alternating square wave is not applied while the crystal is liquid, the crystal will stay dark.

Frozen liquid crystal displays like this are well known. They are presently being marketed by Crystal Vision, Inc. of Sunnyvale, California.

Apparatus for controlling the whitening of the markers is shown in FIG. 36. Referring to FIG. 36, power supply 104 provides an alternating square wave potential of ten volts. In order to produce the diatonic display pattern shown in FIG. 37, switch 102 is set to position 1. This applies the alternating potential to the liquid crystal cells marking the set of nine back digitals numbered 4, 12, 18, 26, 32, 40, 46, 54 and 60. All liquid crystal cells are momentarily heated. After the cells cool, the alternating potential is deactivated, leaving the diatonic set of nine markers white, and the other 21 markers dark.

In order to produce the whole-tone display pattern shown in FIG. 39, switch 102 is set to position 2. This applies the alternating potential to liquid crystal cells marking the set of ten back digitals numbered 4, 12, 16, 24, 28, 36, 40, 48, 52 and 60. Again all liquid crystal cells are momentarily heated to make the change.

Equipment for momentarily heating and activating frozen liquid crystal displays of this type is well known. It is presently being marketed by Crystal Vision, Inc.

I claim:

1. An improved musical instrument having a keyboard containing a plurality of fifteen front digitals and a plurality of fifteen back digitals, the front digitals being arranged in a sequence, a single one of the back digitals being positioned between each two consecutive members of the sequence of front digitals, the instrument having tone actuator means for actuating a plurality of twenty-four musical tones, the tones being arranged in a sequence having a musical interval of a single semitone between each two consecutive members of the sequence of tones, the improvement comprising:

electronic key signature actuator circuitry for the digitals to actuate the tone actuator means, there being exactly seven consecutive front digitals per octave span, the circuitry comprising twenty-four electronic tone substitution modules arranged in sequence so that each substitution module activates its single associated member of the sequence of musical tones, each substitution module having left, central, and right input leads receiving signals from their respective members of the two pluralities of digitals, the single digital transmitting a signal to the central input lead of a substitution module being designated its central digital, the substitution module being controlled by left and right enabling leads, when neither enabling lead is energized, the single musical tone associated with the module being played by its central digital, when the left enabling lead is energized the musical tone associated with the module being played by a digital to the left of its central digital, when the right enabling lead is energized the musical tone associated with the module being played by a digital to the right of its central digital.

2. An improved musical keyboard having a plurality of twenty-one front digitals and a plurality of twenty-one back digitals, the front digitals being arranged in a sequence running from left to right, a single one of the back digitals being positioned between each two consecutive members of the sequence of front digitals, the keyboard having tone actuation means for actuating a plurality of at least forty-two musical tones, the tones arranged in a sequence having a musical interval of a single semitone between consecutive members of the sequence, the keyboard having a diatonic key signature actuator coupling the digitals to the tone actuators, the diatonic key signature actuator acting in a diatonic standard state and a plurality of different diatonic key signature actuated states; in the diatonic standard state, each tone played by one of the front or back digitals being designated its diatonic standard tone, a subsequence of eight consecutive front digitals playing eight standard tones spaced by seven interdigital musical intervals of 2-2-1-2-2-2-1 semitones, in each of the diatonic key signature actuated states the subsequence of front digitals playing eight tones spaced by a sequence of seven interdigital musical intervals selected from the group consisting of:

1-2-2-1-2-2-2 semitones,
2-1-2-2-1-2-2 semitones,
2-2-1-2-2-1-2 semitones,
2-2-2-1-2-2-1 semitones,
1-2-2-2-1-2-2 semitones,
2-1-2-22-1-2 semitones, the keyboard having a hexachord key signature actuator acting in a plurality of different hexachord key signature actuated states; in each of the hexachord key signature actuated states a predetermined subsequence of seven consecutive front digitals playing seven tones spaced by a sequence of six interdigital musical intervals selected from the group consisting of:

2-2-1-2-2-3 semitones,
3-2-2-1-2-2 semitones,
2-3-2-2-1-2 semitones,
2-2-3-2-2-1 semitones,
1-2-2-3-2-2 semitones,
2-1-2-2-3-2 semitones, wherein the improvement comprises:

electrical interlock means for automatically disabling the hexachord key signature actuator when the diatonic key signature actuator is enabled and for automatically disabling the diatonic key signature actuator when the hexachord key signature actuator is enbabled.

3. A musical keyboard as in claim 2 wherein, when the diatonic key signature actuator is enabled, exactly K digitals per octave span play tones that are shifted from their standard tones, all of the shifted tones being shifted by a single semitone in the same direction, where K is a number in the range 1 to 11 inclusive, for each predetermined value of K the number of back digitals per octave span which play musical tones being exactly five.

4. An improved musical instrument having tone actuator means for actuating a plurality of at least thirty-six musical tones, the tones arranged in a sequence having a musical interval of a single semitone between consecutive members of the sequence of tones, the musical instrument having a keyboard containing pluralities of twenty-one front digitals and twenty-one back digitals to play the musical tones, there being exactly seven front digitals and exactly seven back digitals per octave span, the front digitals arranged in a sequence running from left to right, a single one of the back digitals being positioned between each two consecutive members of the sequence of front digitals, the musical instrument having electronic circuitry acting in a standard state coupling the digitals to the tone actuators so that a subsequence of eight consecutive front digitals play eight tones spaced by seven interdigital musical intervals of 2-2-1-2-2-2-1 semitones, each tone played by one of the front or back digitals being designated its diatonic standard tone, wherein the improvement comprises:

a plurality of different diatonic key signature actuated states of the electronic circuitry in each of which the subsequence of eight front digitals play eight tones spaced by a sequence of seven interdigital musical intervals selected from the group consisting of 1-2-2-1-2-2-2 semitones,
2-1-2-2-1-2-2 semitones,
2-2-1-2-2-1-2 semitones,
2-2-2-1-2-2-1 semitones,
1-2-2-2-1-2-2 semitones,
2-1-2-2-2-1-2 semitones, exactly K front and back digitals per octave span playing tones that are shifted from their standard tones, all of the shifted tones being shifted by a single semitone in the same direction, where K is a number in the range 1 to 11 inclusive, for each predetermined value of K the number of back digitals per octave span which play a musical tone being exactly five.

5. A musical instrument as in claim 4 in which, in each diatonic key signature actuated state, all of the shifted tones are shifted by a single semitone toward lower pitch.

6. A musical instrument as in claim 5 in which, in each diatonic key signature actuated state, all of the shifted tones are shifted by a single semitone toward higer pitch.

7. An improved musical instrument having tone actuator means for actuating a plurality of at least thirty-six tones, the tones arranged in a sequence having a musical interval of a single semitone between consecutive members of the sequence of tones, the musical instrument having a keyboard containing pluralities of eighteen front digitals and eighteen back digitals to play the musical tones, there being exactly six front digitals and exactly six back digitals per octave span, the front digitals arranged in a sequence running from left to right, a single one of the back digitals being positioned between each two consecutive members of the sequence of front digitals, the musical instrument having electronic circuitry acting in a single primary state coupling the front and back digitals to the tone actuators so that a subsequence of seven consecutive front digitals play a primary tonal hexachord scale consisting of seven tones having six interdigital musical intervals of 2-2-1-2-2-3 semitones, a subsequence of seven consecutive back digitals playing an associated chromatic hexachord scale also having six interdigital musical intervals of 2-2-1-2-2-3 semitones, the chromatic hexachord scale being pitched exactly six semitones higher than its associated tonal hexachord scale and being positioned M digitals to the right of its associated tonal hexachord scale on the keyboard, where the number M is selected from the group consisting of the numbers five and seven, the improvement comprising ten different secondary states of the electronic circuitry in each of which the front digitals play a tonal hexachord scale and the back digitals play its associated chromatic scale pitched exactly six semitones higher, both hexachord scales having interdigital musical intervals of 2-2-1-2-2-3 semitones, in five of the secondary states the tonal hexachord scale being positioned N front digitals to the right of the primary tonal hexachord scale and pitched 2 N semitones higher than the primary tonal hexachord scale, in the other five secondary states the tonal hexachord scale being positioned N front digitals to the right of the primary tonal hexachord scale and pitched 2 N+1 semitones higher than the primary tonal hexachord scale, where N assumes all integral values from 1 to 5 inclusive, in each of the ten secondary states the chromatic hexachord scale being positioned exactly the same number M digitals to the right of its assoicated tonal hexachord scale.

8. The musical instrument of claim 7 in which the number M is five.

9. An improved musical instrument having tone actuator means for actuating a plurality of at least thirty-six musical tones, the tones arranged in a sequence having a musical interval of a single semitone between consecutive members of the sequence of tones, the musical instrument having a keyboard containing pluralities of twenty-one front digitals and twenty-one back digitals to play the musical tones, there being exactly seven front digitals and exactly seven back digitals per octave span, the front digitals arranged in a sequence running from left to right, a single one of the back digitals being positioned between each two consecutive members of the sequence of front digitals, the musical instrument having electronic circuitry acting in a standard state coupling the digitals to the tone actuators so that a subsequence of eight consecutive front digitals play eight tones spaced by seven interdigital musical intervals of 2-2-1-2-2-2-1 semitones, each tone played by one of the front or back digitals being designated its diatonic standard tone, wherein the improvement comprises:

a plurality of different diatonic key signature actuated states of the electronic circuitry in each of which the subsequence of eight front digitals play eight tones spaced by a sequence of seven interdigital musical intervals selected from the group consisting of 1-2-2-1-2-2-2 semitones,
2-1-2-2-1-2-2 semitones,
2-2-1-2-2-1-2 semitones,
2-2-2-1-2-2-1 semitones,
1-2-2-2-1-2-2 semitones,
2-1-2-2-2-1-2 semitones;

exactly K front and back digitals per octave span playing tones that are shifted from their standard tones, all of the shifted tones being shifted by a single semitone in the same direction, where K is a number in the range 1 to 11 inclusive, the back digitals being shaded white and dark in a repetitive pattern with a repetition period of seven back digitals, the pattern repeating itself twice within the plurality of twenty-one back digitals, the pattern consisting of three dark shaded back digitals followed by a central single white back digital, followed by two consecutive dark shaded back digitals followed by a final single white back digital, the plurality of front digitals comprising a central single front digital positioned to the immedicate right of a central white back digital, and five marked front digitals on each side of the central front digital, the marked front digitals being separated from each other and from the central front digital by single unmarked members of the plurality of front digitals.

* * * * *